United States Patent [19]

Young et al.

[11] 3,934,756

[45] Jan. 27, 1976

[54] BLENDING-TYPE MOTOR FUEL DISPENSING APPARATUS

[75] Inventors: Einar T. Young, Newtown Square; Stephen M. Fromnick, Glen Riddle; Robert Mayer, Ardmore; Robert H. Livesay, West Chester, all of Pa.

[73] Assignee: Sun Oil Company of Pennsylvania, Philadephia, Pa.

[22] Filed: Mar. 27, 1974

[21] Appl. No.: 455,476

[52] U.S. Cl. ..... 222/28; 222/134

[51] Int. Cl.[2] ..... B67D 5/22

[58] Field of Search ..... 222/25–28, 222/134, 145, 136; 235/92 FL, 151.34; 137/88

[56] References Cited

UNITED STATES PATENTS

| | | | |
|---|---|---|---|
| 3,130,870 | 4/1964 | Phillips | 222/26 |
| 3,219,046 | 11/1965 | Waugh | 235/151.34 |
| 3,229,077 | 1/1966 | Gross | 235/92 FL |
| 3,756,463 | 9/1973 | Gravina | 222/26 |
| 3,777,935 | 12/1973 | Storey | 222/26 |
| 3,782,597 | 1/1974 | Hansen | 222/28 |

*Primary Examiner*—Stanley H. Tollberg
*Assistant Examiner*—John P. Shannon
*Attorney, Agent, or Firm*—J. Edward Hess; Donald R. Johnson; William C. Roch

[57] ABSTRACT

A blending-type motor fuel dispensing apparatus operates to blend together, in various proportions, two liquid motor fuels (gasolines) of different octane ratings, to produce various grades of product. The quantity and cost displays, and also the automatic control of the blend during dispensing, are based upon the summation of two sets of pulses, the number of pulses in each set being proportional to the integrated flow rate of a corresponding one of the two fuels. The pulses are counted and multiplied by a price per gallon, which has been previously set for the grade being dispensed, to provide a cost display. A pulse comparison circuit, which compares pulses representative of the flow of one fuel with a percentage (settable for each blend) of the summed pulses, is used to control the proportioning of the two fuels.

Selection of a desired product for dispensing (one out of five products, for example) is made by operating an appropriate pushbutton; when this is done, the proportioning control valves are automatically pre-positioned to a setting corresponding to the particular selection that has been made.

11 Claims, 21 Drawing Figures

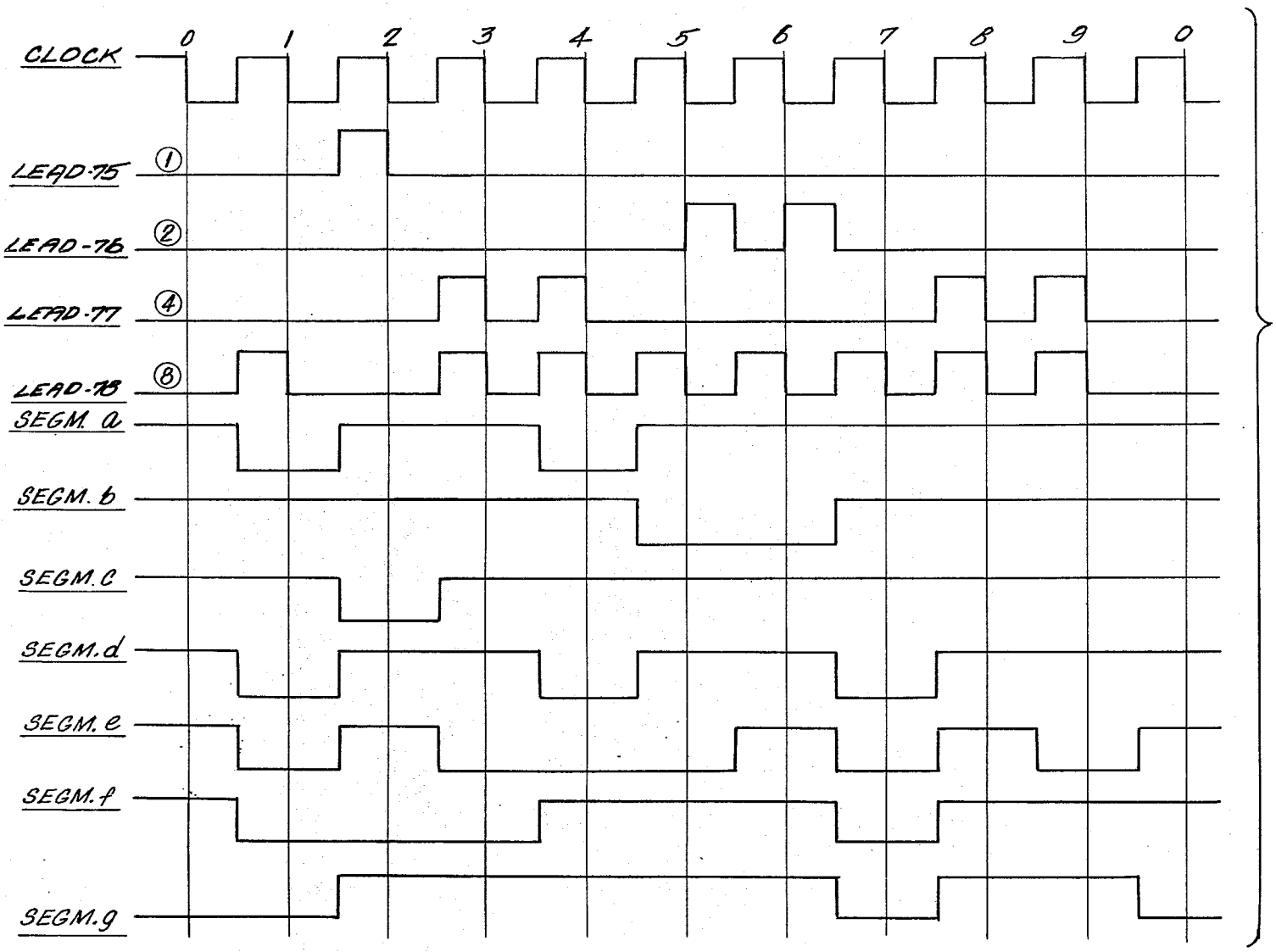
FIG.6.
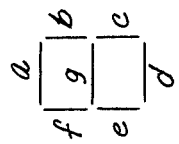

STB 2 IN
214
"BLEND SELECTED" TO FIG.16
220
219
217
218
"HI" (SUPER PREMIUM)
BLEND-A (PREMIUM)
BLEND-B (SUPER REGULAR)
BLEND-C (REGULAR)
"LO" (ECONOMY REGULAR)
204
RESET (STB-1) IN
PRICE PULSES OUT
"HI" PULSES (REF) OUT
TO SELN. INDICATOR CKTS.
"SUPER PREMIUM" OUT-TO FIG.12
"ECONOMY REGULAR" OUT-TO FIG.12
249
232
TO TFR. GATE-188
TO TFR. GATE-189
TO TFR. GATE-190

BLENDING-TYPE MOTOR FUEL DISPENSING APPARATUS

This invention relates to motor fuel dispensing apparatus and more particularly to dispensing apparatus of the so-called "multigrade" type, wherein a plurality of different grades of fuel (each having a different octane rating) are selectively dispensed by a single apparatus; these various grades are provided by various blends of two fuel components of different octane ratings, and in addition by solely one component and solely the other component. Since such apparatus provides blends, it may be termed "blending-type" apparatus.

Examples of blending-type motor fuel dispensing apparatus according to the prior art are described in Young U.S. Pat. No. 2,880,908, referred to hereinafter as the '908 patent, and in Young U.S. Pat. No. 3,587,337, referred to hereinafter as the '337 patent. The '908 patent discloses a blending-type dispensing apparatus which is now being used to a considerable extent in gasoline marketing operations, in service stations; this apparatus is 100% mechanical in construction. The '337 patent discloses a simplified blending-type dispensing apparatus which utilizes pushbuttons for motor fuel grade selection; here again, however, the apparatus is essentially entirely mechanical in construction.

An electronic blending apparatus offers several advantages, as compared to a mechanical apparatus. In the first place, since there are very few moving parts to wear out, the maintenance costs are lower. Again, since an electronic apparatus is more compact than a mechanical one, and is in general of modularized construction, all units are readily accessible, and may be easily replaced.

In addition, the electronic blending apparatus of the invention, utilizing pushbuttons, is easy to operate. This makes it attractive to customers, for self-service, and makes it highly beneficial even for attended operation.

The electronic blending apparatus of this invention provides improved accuracy, due to an automatic pre-positioning of the blend control valve effected before actual dispensing begins. As compared to the mechanical apparatus typefied by the above-mentioned patents, the starting error is reduced by at least a factor of five.

An electronic blending apparatus can provide for extreme flexibility in price settings. By way of example, any product (i.e., any "grade" of gasoline, the number of "grades" usually being two greater than the number of "blends") can be priced independently, anywhere within the range of 0.1 to 99.9 per gallon (or per liter).

An electronic blending apparatus can provide for extreme flexibility in blend percent settings. By way of example, the percentage of one component (a certain one, of two components) in any blend can be set independently, anywhere within the range of 1% to 99%, in steps of 1%.

An electronic blending apparatus enables convenient data collection. Data on total gallons of any selected liquid fuel (blend, or individual component) sold, total dollars, etc., can be made available in the service station building, for local collection, or for transmittal over lines.

Prior gasoline blending apparatus, such as that described in the '908 patent, is quite bulky and voluminous. The electronic blending apparatus of this invention, on the other hand, is much less bulky, so that the apparatus readily lends itself to the design of dual blenders, with a resulting first cost per outlet less than is possible with known apparatus. Also, the apparatus of this invention costs less to install, since one set of suction pipes and one electrical conduit will serve two outlets.

The electronic blending apparatus of the invention provides improved flexibility in arrangement, since the blend control box and the hose can be located remotely from the remainder of the components. This flexibility would allow various special arrangements; one possibility would be pedestal mounting, as described hereinafter.

An object of this invention is to provide a novel electronic blending-type gasoline dispensing apparatus.

Another object is to provide an electronic blending-type gasoline dispensing apparatus which is of greatly simplified operation and is therefore eminently suitable for self-service.

A further object is to provide an electronic blending apparatus which entails the advantages (as compared to a mechanical blending apparatus) previously set out.

A detailed description of the invention follows, taken in conjunction with the accompanying drawings, wherein.

Figure 4A:
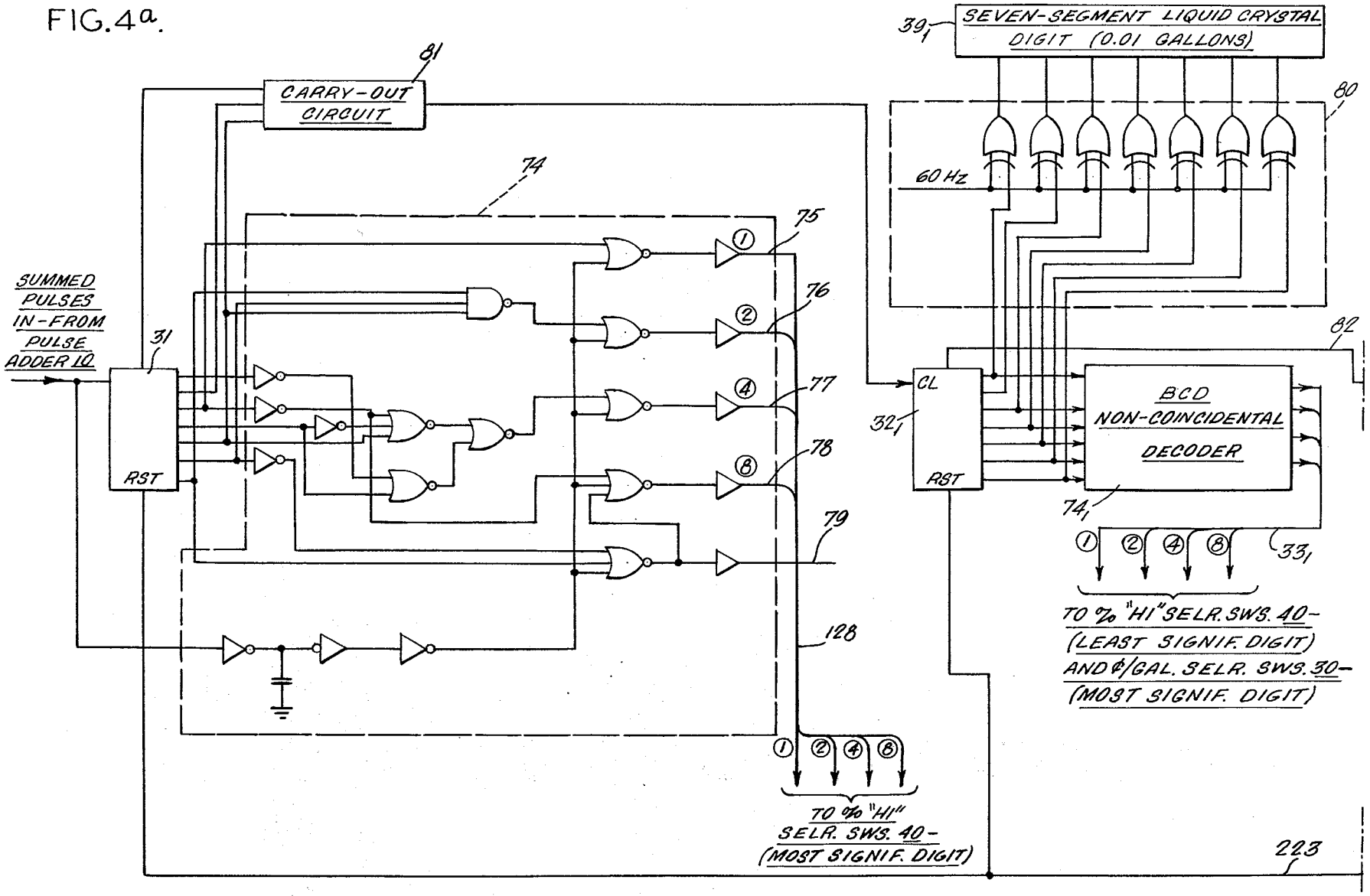
Figure 4B:
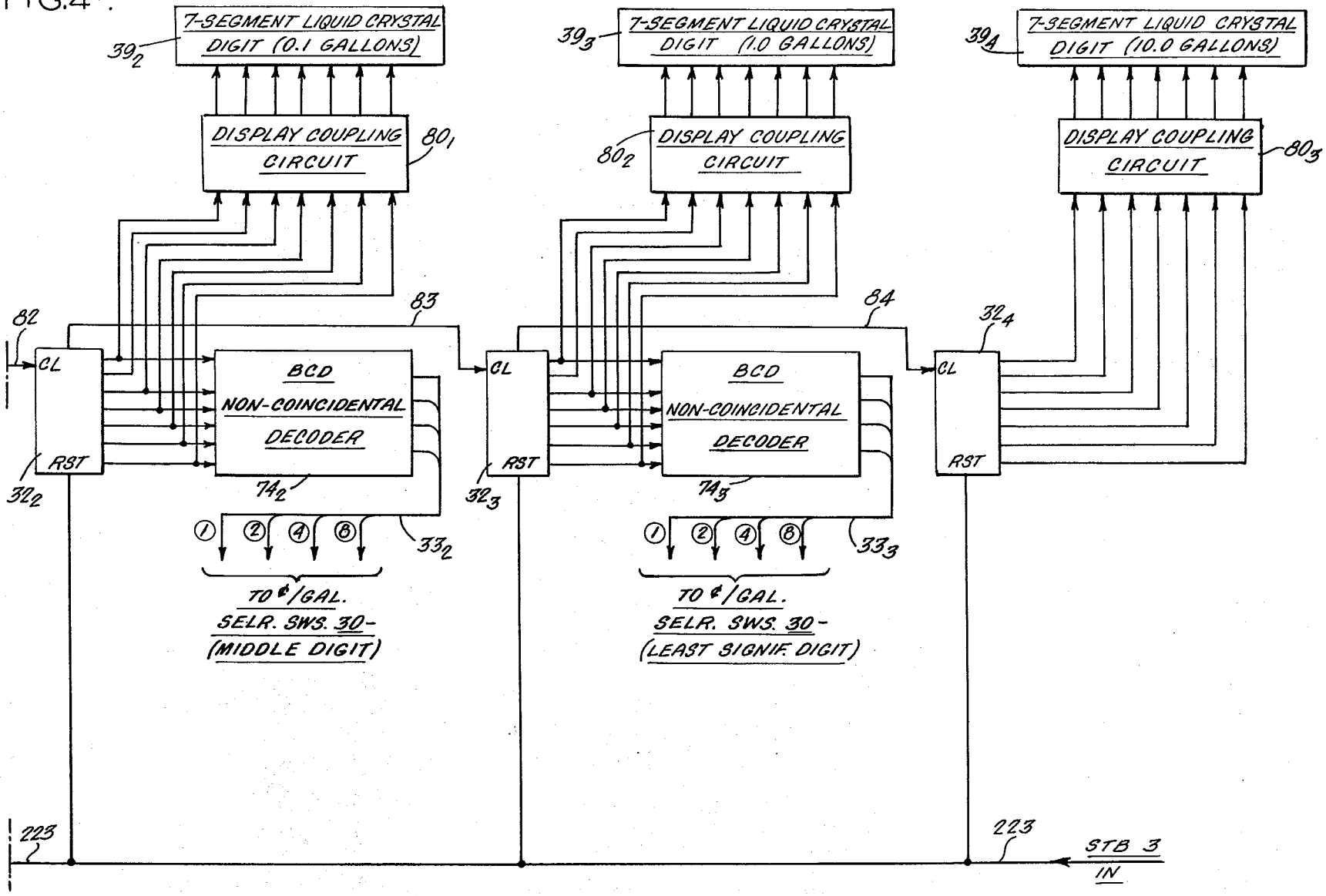
Figures 7, 17:
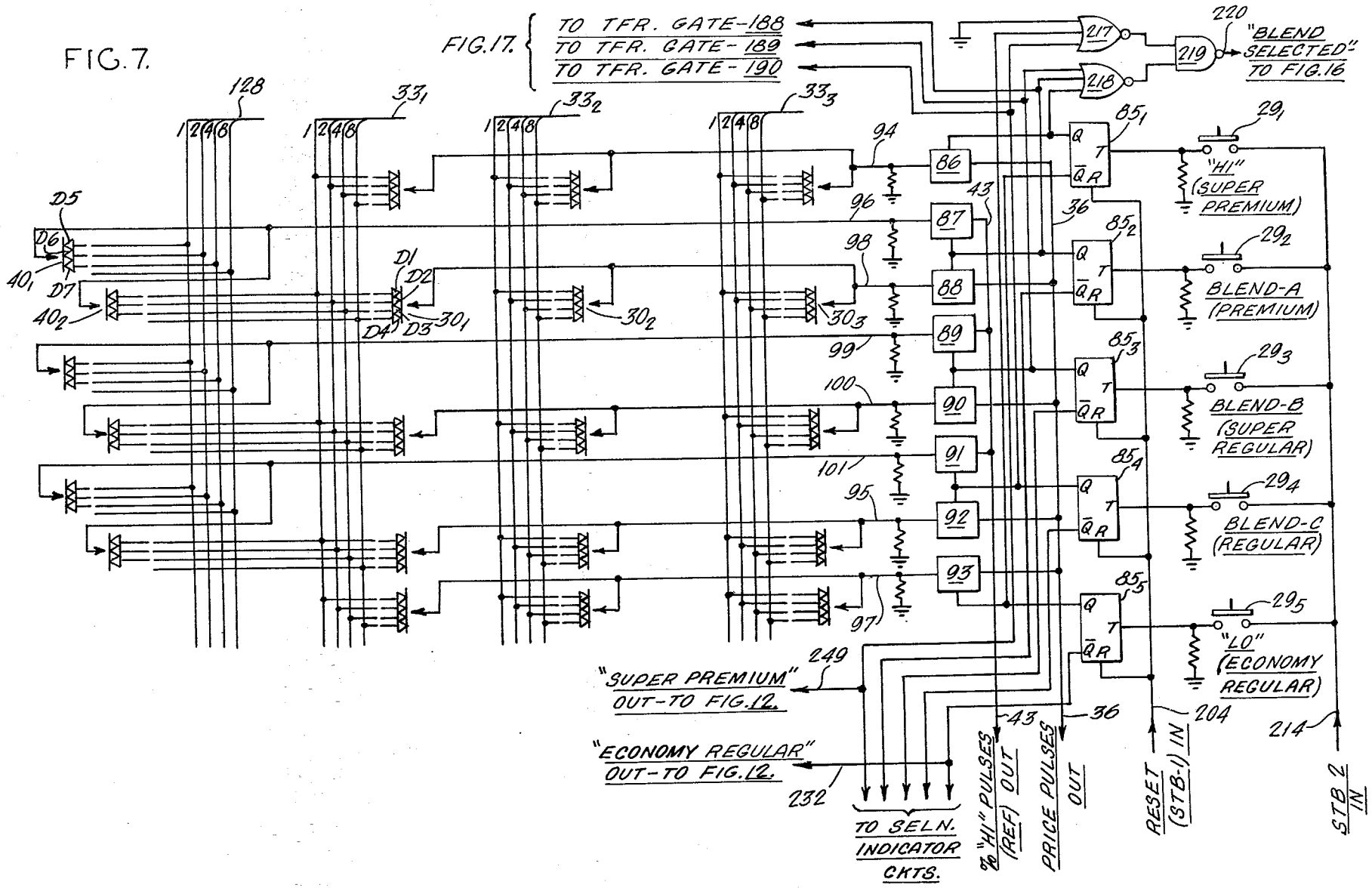
Figure 8:
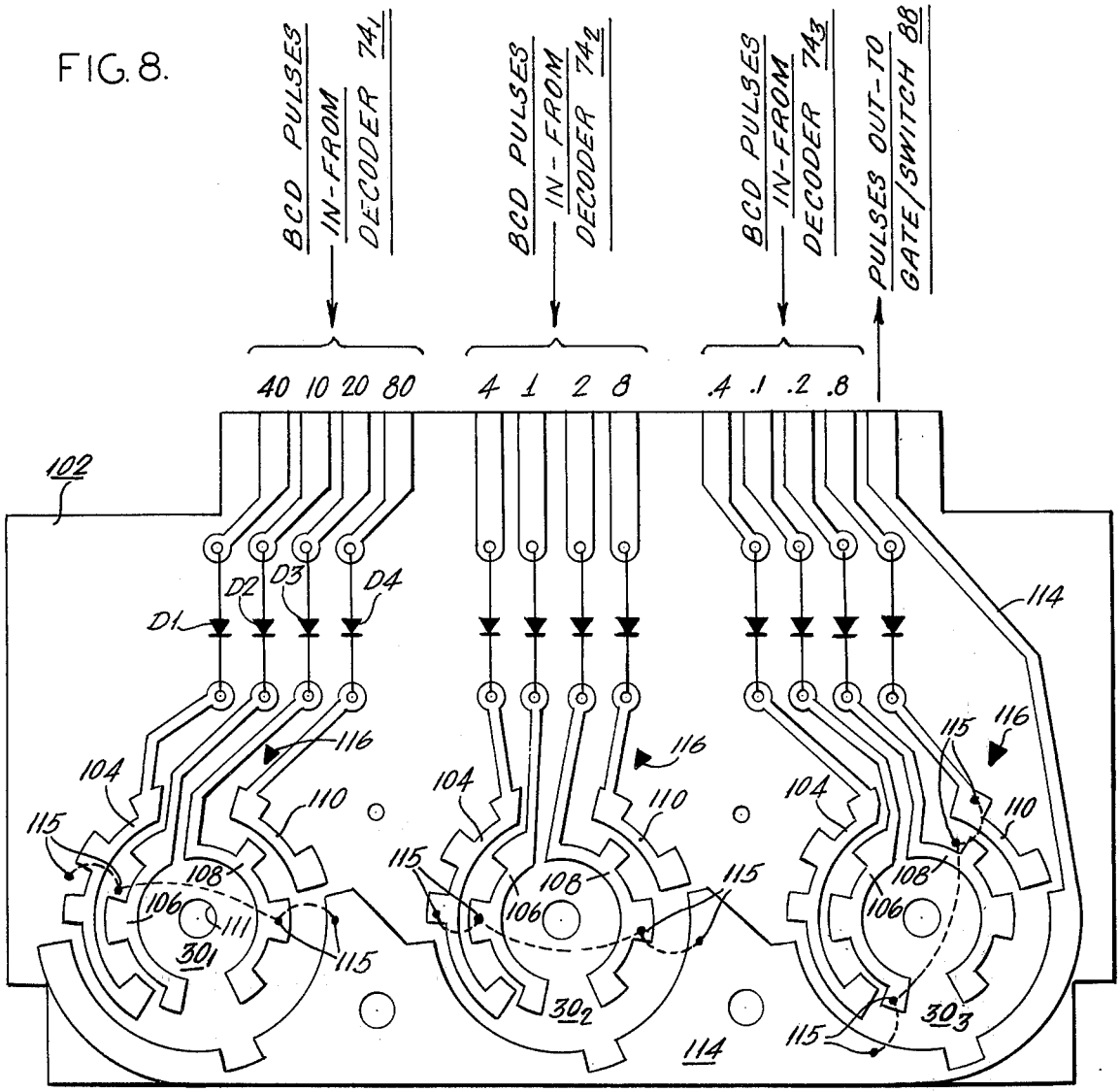
Figure 9:
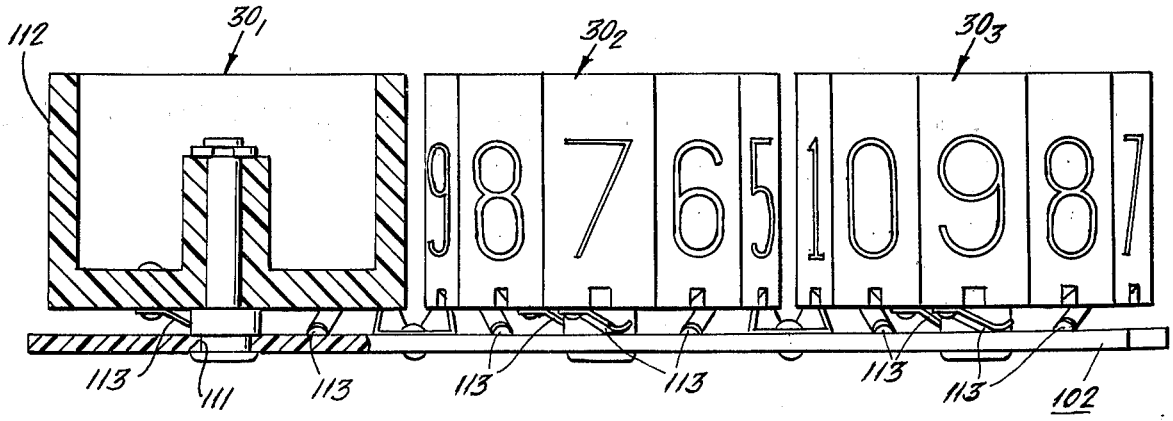
Figure 10:
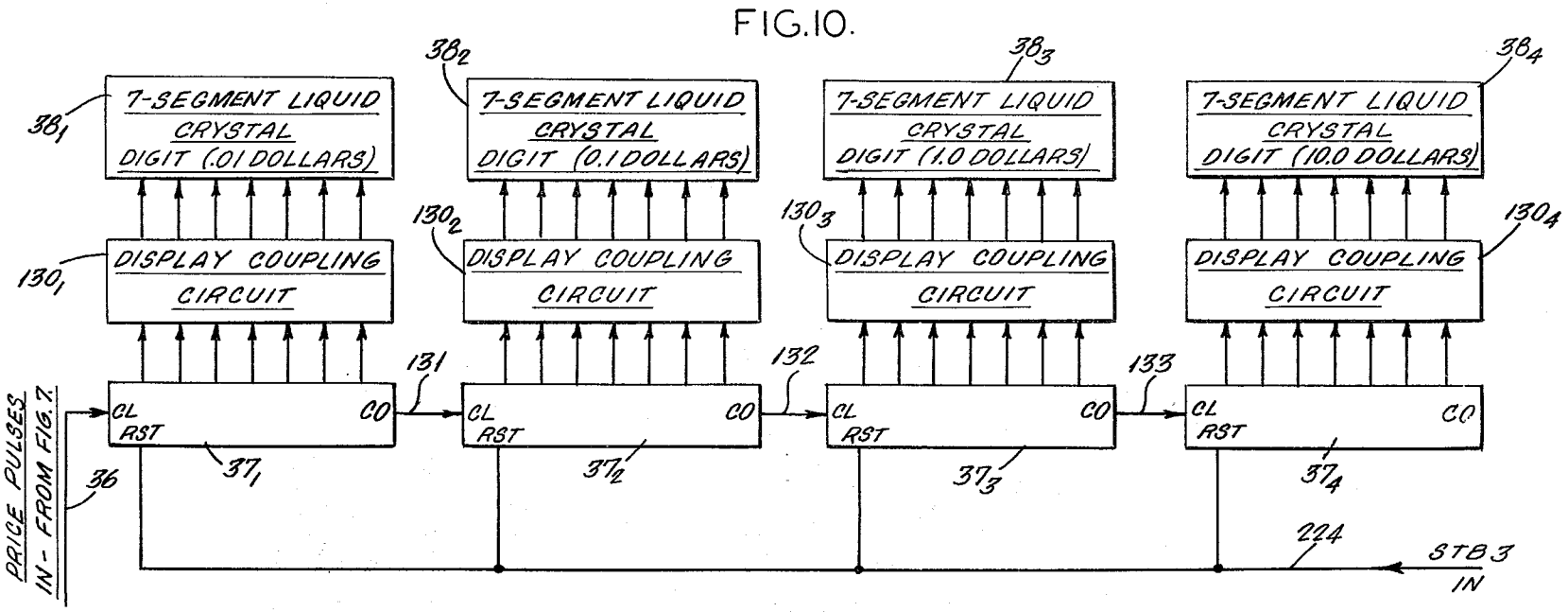
Figure 11:
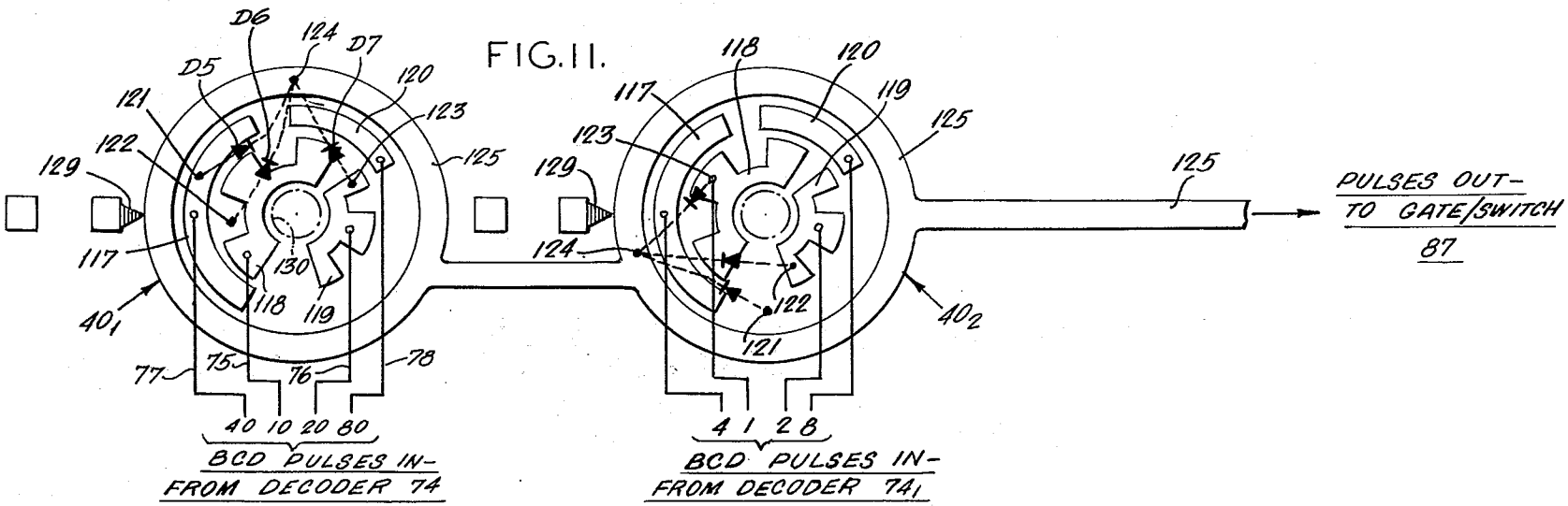
Figure 12A:
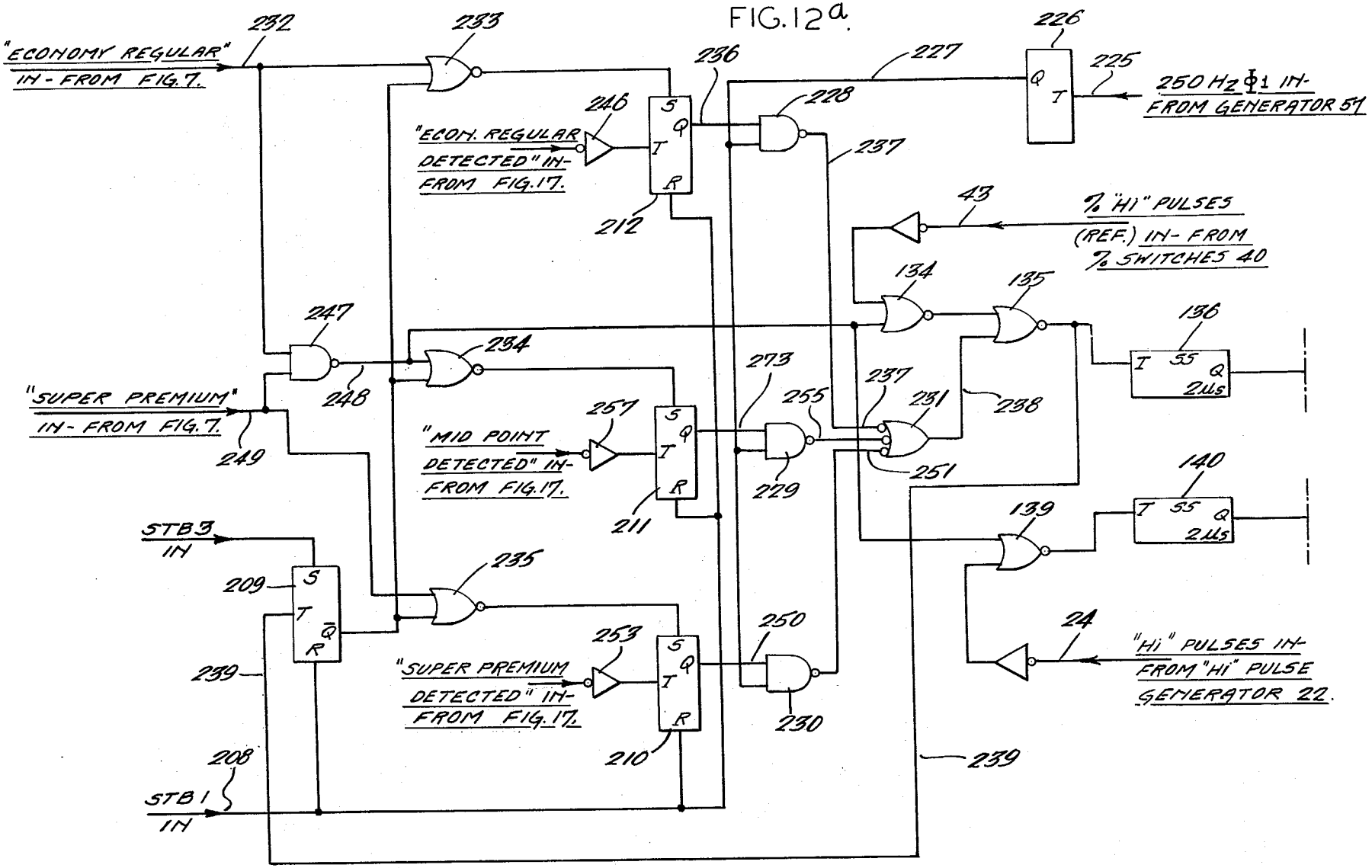
Figure 12B:
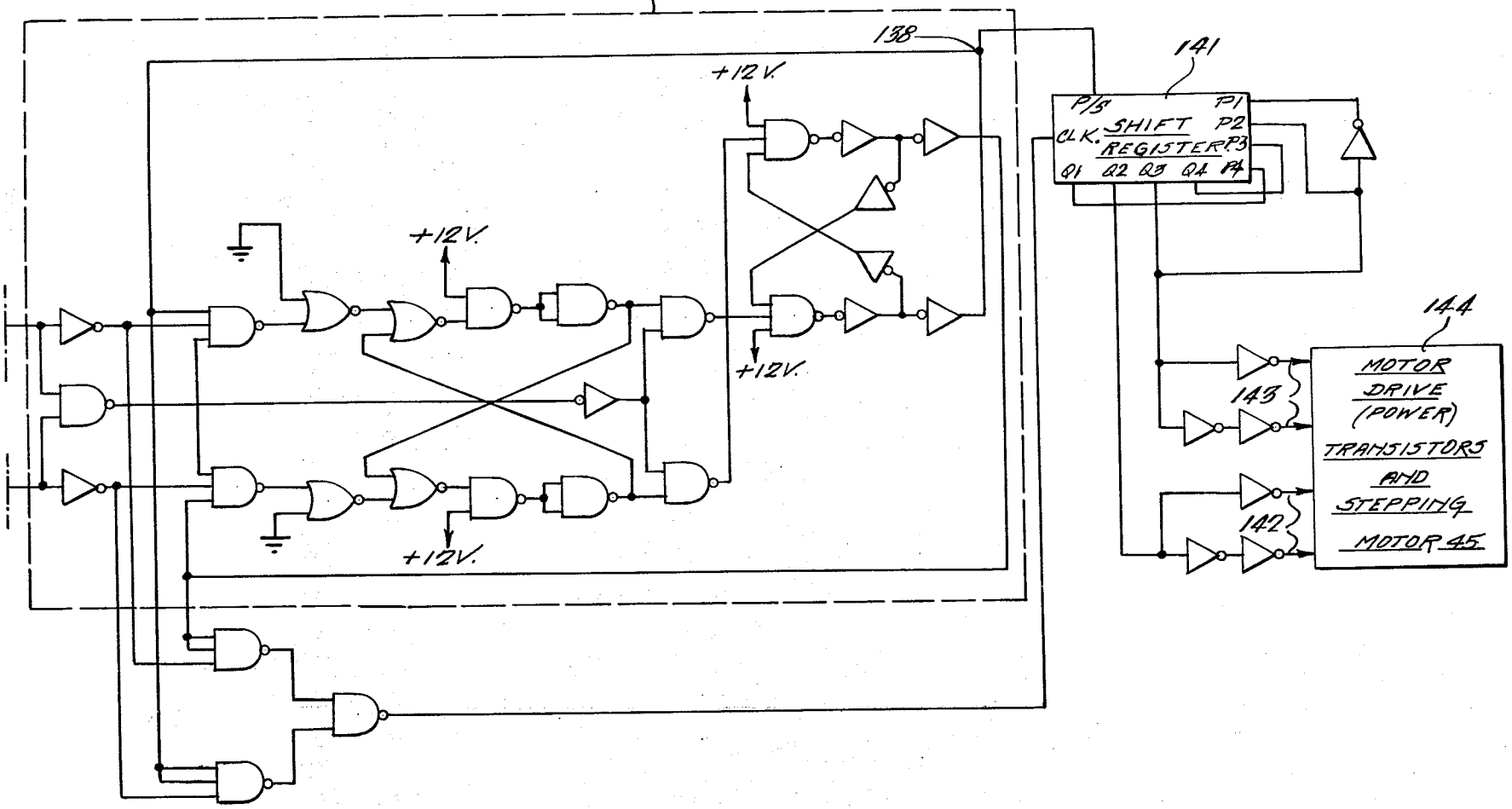
Figures 13, 14A:
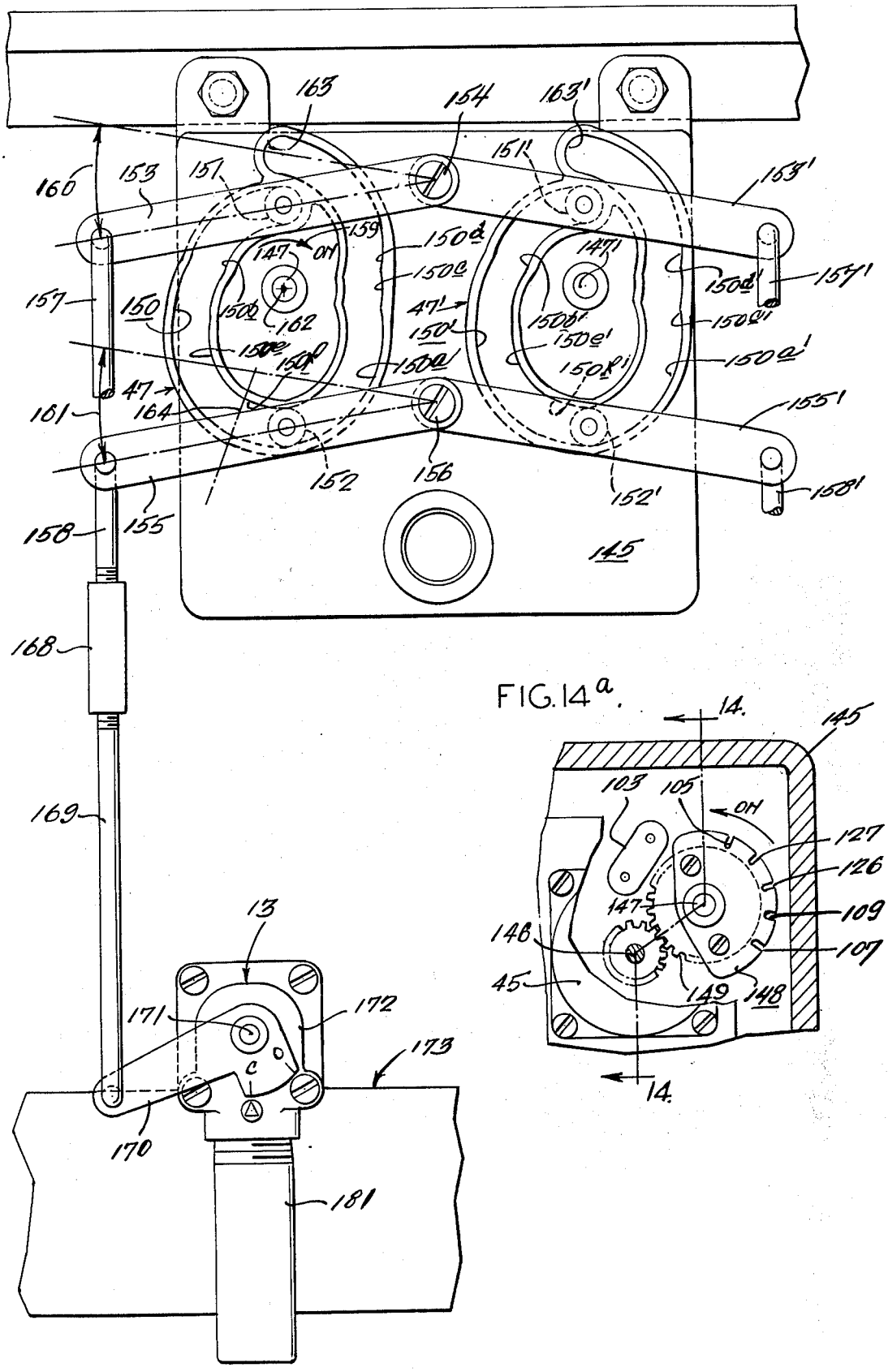
Figure 14:
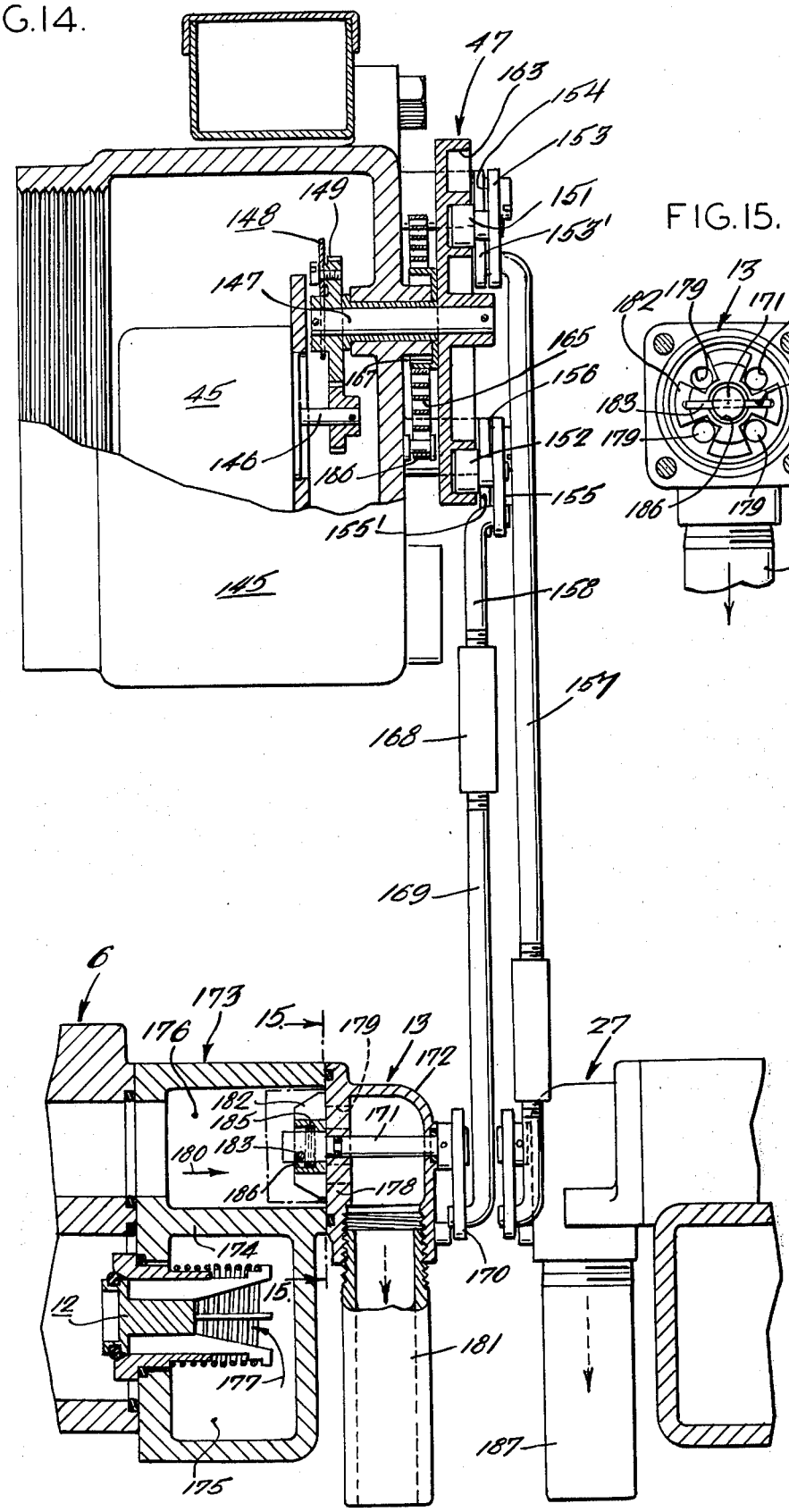
Figure 15:
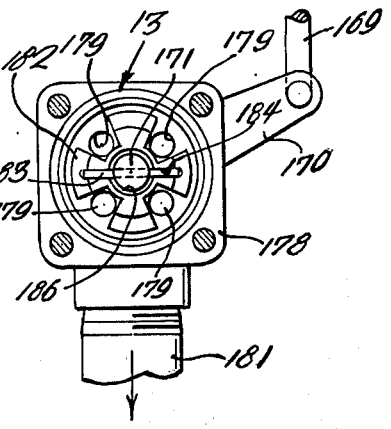
Figure 16:
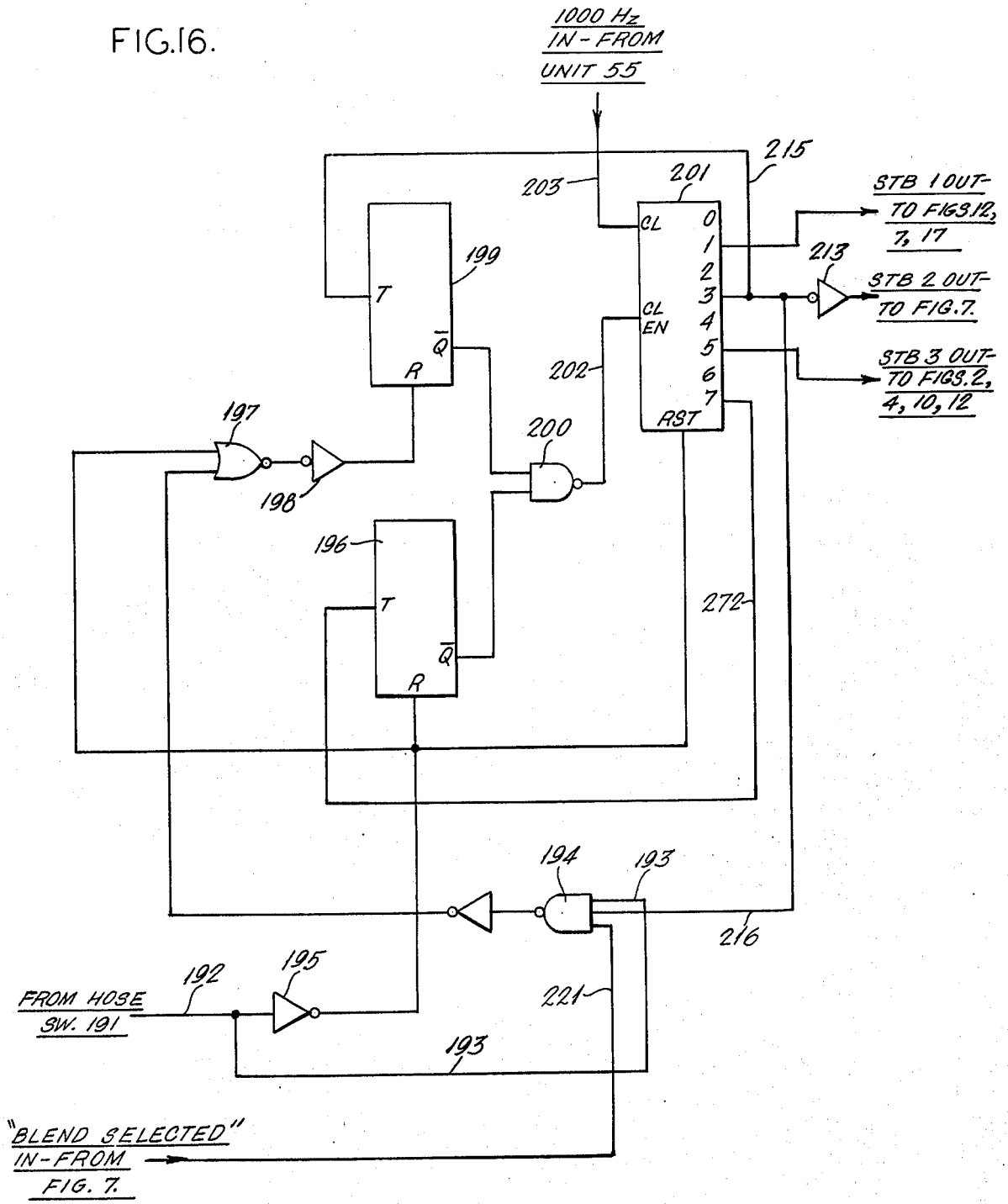
Figure 17:
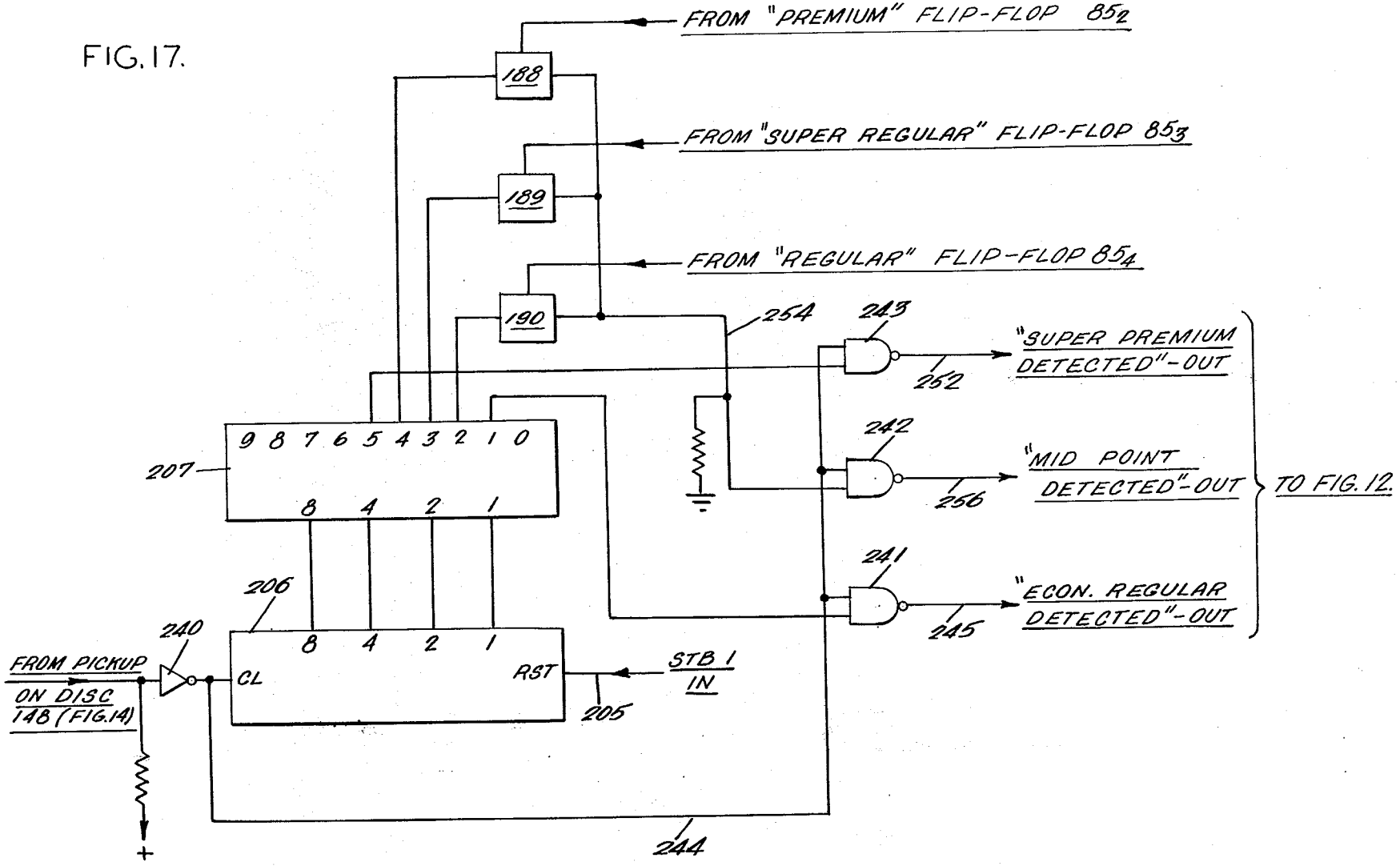
Figure 18:
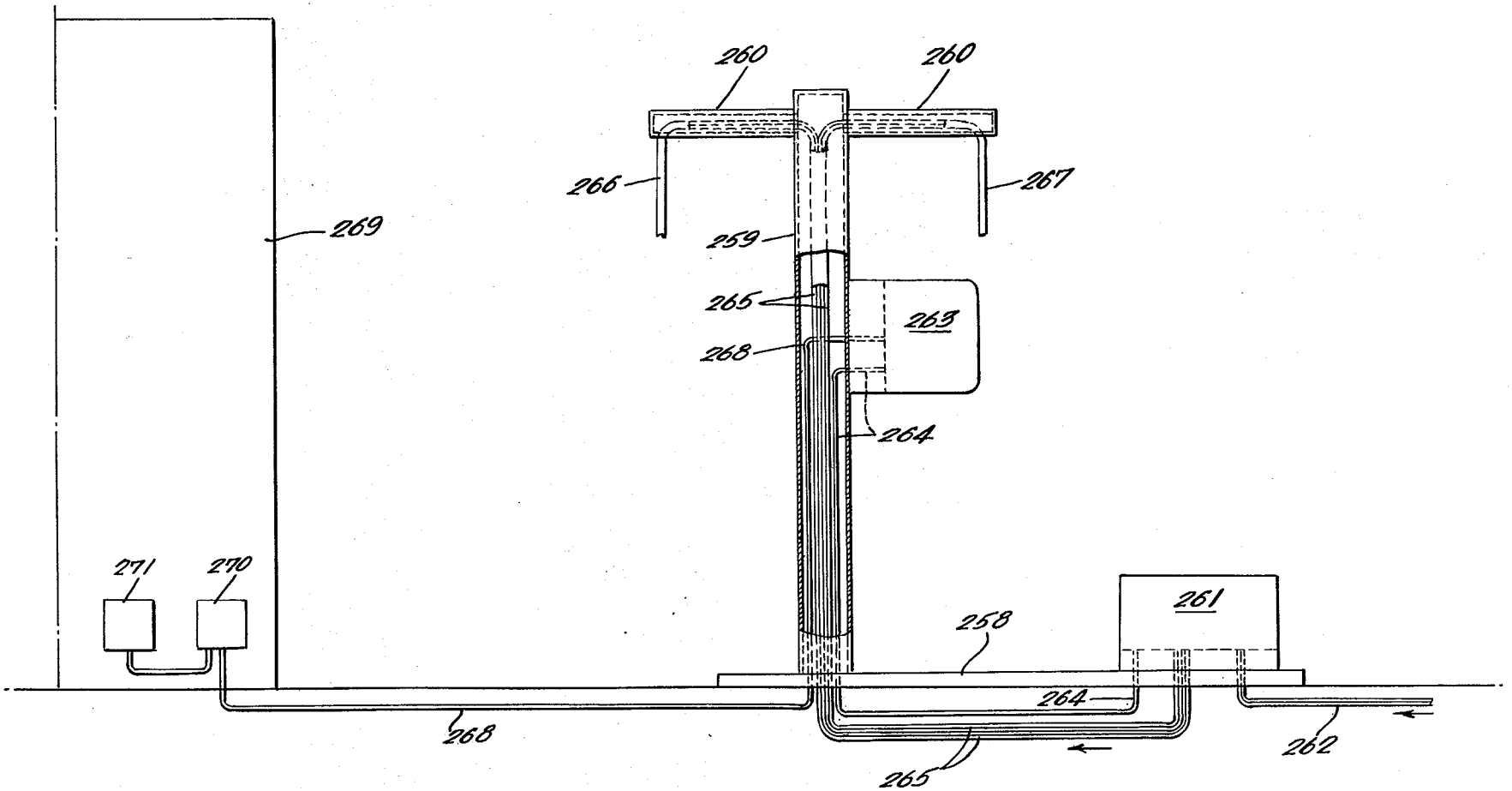

FIG. 4 (made up of two parts, FIG. 4*a* and FIG. 4*b*) is a logic diagram of the gallons counters, associated decoders, and the gallons display;

FIG. 5 is a timing-coding diagram useful in explaining the invention;

FIG. 6 is a segment-digit key for FIG. 5;

FIG. 7 is a schematic circuit diagram of the blend select, percent "hi" select, and price select portions of the apparatus;

FIG. 8 is a plan view of a price selector printed circuit board;

FIG. 9 is a front elevation, partly in section, of a set of price selector switches;

FIG. 10 is a block diagram of the dollars counters and dollars display;

FIG. 11 is a schematic plan view of a percent selector switch arrangement;

FIG. 12 (made up of two parts, FIG. 12*a* and FIG. 12*b*) is a logic diagram of the motor control portion of the apparatus;

FIG. 13 is a face view of the mechanism which operates the blend control valves;

FIG. 14 is a side view, partly in section along line 14—14 of FIG. 14*a*, of the mechanism of FIG. 13;

FIG. 14*a* is a face view of a portion of the mechanism of FIG. 13;

FIG. 15 is a face view of a blend control valve, taken in the direction 15—15 of FIG. 14;

FIG. 16 is a logic diagram of a start-up strobe generator;

FIG. 17 is a logic diagram of a position detector, used in pre-positioning of the blend control valves; and FIG. 18 is a diagrammatic view of a physical layout utilizing the apparatus of the invention.

Figure 1:
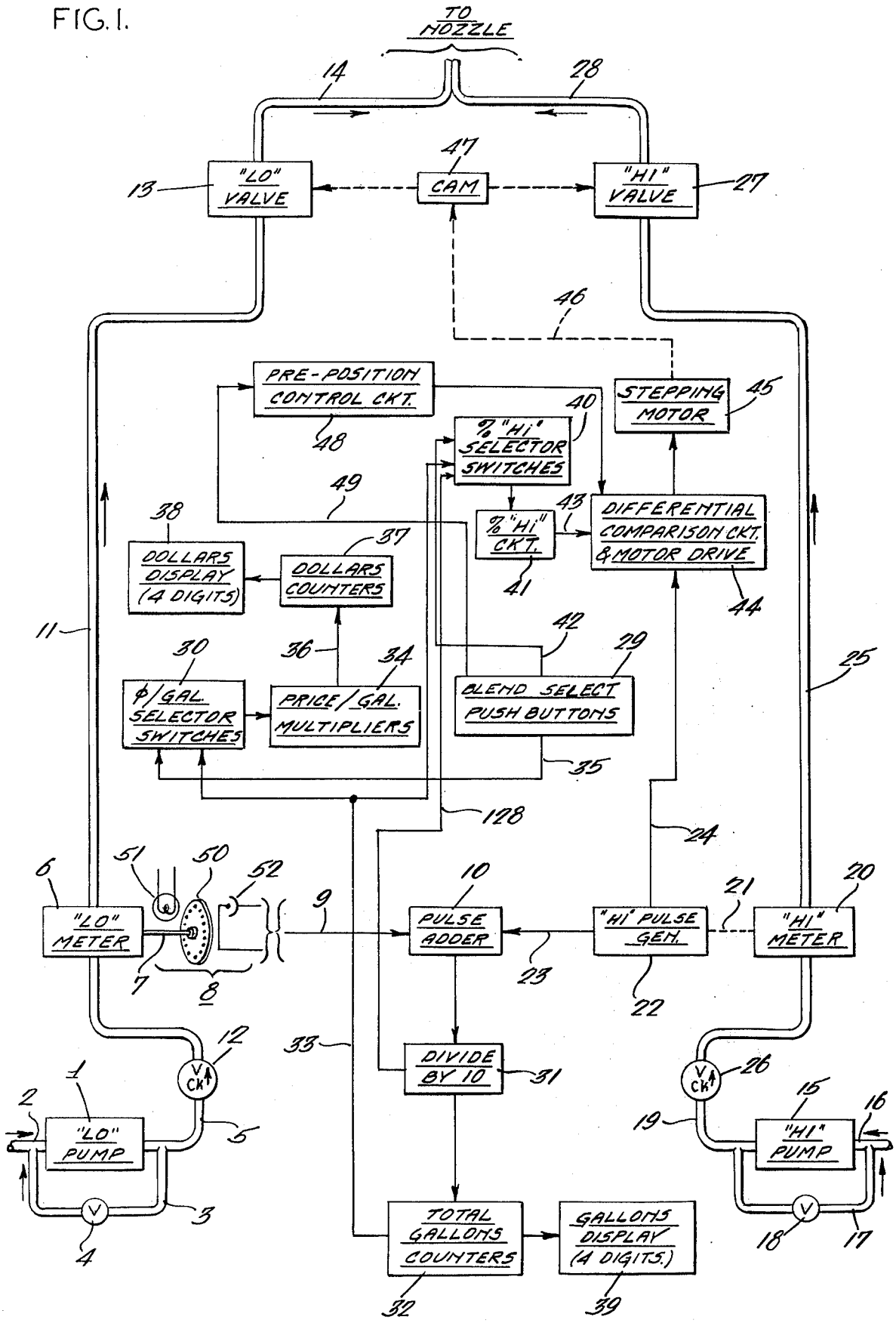
FIG. 1 is a block diagram illustrating the liquid, mechanical, and electrical connections of various elements involved in a dispensing apparatus according to this invention.

Refer first to FIG. 1, for a somewhat generalized description of the apparatus of the invention. A "lo" (for relatively low-octane liquid fuel component) pump 1 is driven by a motor as is usual and is arranged to receive through pipe 2 from a supply tank the lower-octane gasoline referred to above. In FIG. 1, for convenience, the pump 1 is illustrated as being located in the dispensing apparatus housing or casing; however, in many instances this pump would be of the submersible type and would be located in the underground supply tank or storage tank containing the "lo" fuel. In the usual fashion, the "lo" pump 1 is provided with a bypass 3 in which is located a loaded relief valve 4 so that if the delivery hose outlet is shut off the "lo" pump may continue to operate, recirculating the "lo" gasoline through the valve 4 from its outlet to its inlet. Delivery of gasoline from the "lo" pump takes place through a pipe 5 which delivers the gasoline through a check valve 12 into a "lo" meter 6 which meter may be of conventional type. The meter 6 accurately measures the liquid flowing therethrough; this meter has an output shaft, schematically indicated at 7, which rotates at a rate proportional to the volumetric flow of liquid (gasoline) through such meter.

The meter shaft 7 mechanically drives a "lo" pulse generator 8 (later detailed) which operates to produce output pulses at 9 at the rate of 1000 pulses per gallon of "lo" gasoline flowing through the meter 6. The pulse output of generator 8 is fed to a pulse adder 10 as one of the two inputs to such adder.

From the meter 6, the "lo" gasoline is delivered through a pipe 11 to a "lo" blend control valve 13 (later detailed) from which it is delivered through a conduit 14 extending to a blending-type nozzle (not shown).

A "hi" (for relatively high-octane liquid fuel component) pump 15 draws its supply of "hi" gasoline from a tank through pipe connection 16. This pump 15 may be of the same type as the "lo" pump 1 and has provided in association with it a bypass 17 incorporating a relief valve 18.

The "hi" pump 15 delivers "hi" gasoline through line 19 containing a check valve 26 to the meter 20 which may be of the type serving to meter the "lo" gasoline (to wit, meter 6). The output shaft 21 of meter 20 (which rotates at a rate proportional to the volumetric flow of liquid such as gasoline passing through this meter) mechanically drives a "hi" pulse generator 22 which operates to produce output pulses at 23 and 24 at the rate of 1000 pulses per gallon of "hi" gasoline flowing through the meter 20. Output pulses are fed at 23 from the generator 22 to the adder 10, as the other of the two inputs to such adder.

Delivery from the meter 20 takes place through piping 25 to a "hi" blend control valve 27 (later detailed) from which it is delivered through a conduit 28 to the nozzle aforementioned.

The valves 13 and 27 deliver the "lo" and "hi" gasolines through a twin hose arrangement (involving the conduits 14 and 28) which provides for admixture of the "lo" and "hi" liquid fuel components at the location of the manually-operated control valve of a dispensing nozzle.

The solid connecting lines provided with arrows in FIG. 1 indicate electrical connections; the dotted connecting lines indicate mechanical connections; and the double lines indicate fluid connections (piping).

For purposes of the present invention, and for simplicity in showing, it may be assumed that the apparatus is capable of delivering five different grades of motor fuel, including as one grade the "lo" gasoline alone and as another grade the "hi" gasoline alone. By way of illustration, these five grades may be denoted by the following terms, beginning with the highest octane fuel and proceeding downwardly, in the direction of decreasing octane: "super premium" ("hi" gasoline only); "premium" (herein termed Blend A); "super regular" (herein termed Blend B); "regular" (herein termed Blend C); and "economy regular" ("lo" gasoline only). On the face of a dispensing apparatus enclosure or housing according to this invention, there is an array of five blend select pushbuttons 29, one adjacent to and correlated with each respective one of the above terms (imprinted as legends on the housing face). These pushbuttons are manually operable individually to select for dispensing any one of the five grades.

Also on the housing face is a set of three openings for each one of the five grades, and positioned behind each of these openings is an individual manually-operable selector switch (thumbwheel switch) 30, the switches being settable (when the transparent protective cover for the face is removed) to establish the prices per gallon for the various grades. Thus, the cents-per-gallon selector switches are settable by the service station operator (dealer). Each of the individual switches contains a series of numerals ranging from zero to nine, the particular numeral corresponding to the switch position selected being visible through the housing face opening for that switch. There are three price selector switches 30, related to each other in decade fashion, for each of the five grades, so that by setting these switches any grade (i.e., any dispensed product) can be priced independently anywhere within the range of 0.1 cent to 99.9 cents per gallon.

As previously described, the pulse output of generator 8 (representing the flow of "lo" gasoline through the meter 6) and the pulse output of generator 22 (representing the flow of "hi" gasoline through the meter 20) are summed or added in the pulse adder 10, to provide an output from this adder representing the combined flow of both liquids. Since the number of pulses in the output of each of the generators 8 and 22 corresponds to the quantity of fuel measured by the associated meter, the pulse summation (output of adder 10) represents the total quantity of fuel delivered or dispensed.

The output of pulse adder 10 is passed through a divide-by-ten circuit 31 and then applied to a decade arrangement 32 of total gallons counters, for counting the number of pulses in the output of divider 31.

A train of pulses, corresponding to the summed-pulse output of divider 31, is taken off at 33 and fed to the selector switch arrangement 30. Each of the five sets (of three each) of switches in the arrangement 30, in effect, selects for utilization in a price-per-gallon multiplier arrangement 34 (which may be simply an amplifier) a certain number of pulses which is determined by the switch settings. The particular set of selector switches in 30 which is utilized in a dispensing operation depends upon which of the five "blend select" pushbuttons in 29 has been operated; this is indicated by the connection 35. It may be noted that the pulses selected by the switches 30 are selected from the summed (total-quantity-of-liquid) pulses supplied thereto via 33.

The selection of a certain number of pulses (which number corresponds to the price, to the tenth of a cent, per gallon of gasoline being dispensed), from the summed, total-quantity pulses, has the effect of a multiplication of the quantity (gallons) of liquid dispensed times the price per gallon (in cents), developing at the output 36 of the multipliers 34 a number of pulses directly indicative of the cost of the liquid fuel (gasoline) dispensed. These pulses are counted by a decade arrangement 37 of dollars counters, and these last-mentioned counters provide an output to a four-digit dollars diplay (total price exhibiting means) 38. The four digits of the dollars display give the price of the fuel dispensed to the hundredth of a dollar (that is, to whole cents). The display 38 is preferably a seven-segment, liquid crystal display (that is, one wherein seven segments are used in combinations to form the various numerals zero through nine, for each digit). The four-digit dollars display 38 is mounted in close juxtaposition to the face of the dispensing apparatus housing, so that the digits thereof are visible through suitable openings in the housing face.

The summed, total-quantity-of-liquid pulse train output of divider 31 is counted by the gallons counters 32, and these last-mentioned counters provide an output to a four-digit gallons display (total volume or quantity exhibiting means) 39. The four digits of the gallons display give the total volume of fuel dispensed to the hundredth of a gallon. The display 39, like display 38, is a seven-segment, liquid crystal display, and, like the latter, is mounted in close juxtaposition to the housing face so that the digits of display 39 are visible through openings provided in the housing face.

The dispensing apparatus of this invention also includes a set of two manually-operable selector switches 40 for each of the three blended products A, B, and C, these switches being set-table to pre-set or establish the percent of "hi" gasoline in each of these three blends. The percent switches 40, unlike the price switches 30, are not accessible to the service station operator or dealer, but only to authorized maintenance personnel. Each of the percent switches 40 is settable to any one of ten positions, labeled respectively zero through nine, and since the two switches of each set are related to each other in decade fashion, any of the three blends A, B, or C can be set independently (by setting the appropriate set of switches 40) within the range of 1% "hi" to 99% "hi", in steps of 1%.

The connection 33 branches off to the percent selector switch arrangement 40, so that the summed-pulse output of divider 31 is also fed to the percent switches 40. Also pulses are taken off from divider 31 (which pulses are in effect generated within this divider) and fed by connection 128 to percent switches 40. Each of the three sets (of two each) of switches in the arrangement 40 selects for utilization in a percent "hi" circuit 41 (which may be simply an amplifier), from the summed (total-quantity-of-liquid) pulses supplied thereto, a certain percentage of the pulses which is determined by the switching settings. The particular set of selector switches in 40 which is utilized in a dispensing operation depends upon whether or not one of the three blends A, B, or C has been selected by the pushbuttons 29, and if so, which one of the three; this is indicated by the connection 42.

The certain percentage of pulses selected (according to the preset percent switches 40) from the summed, total-quantity pulses represents the flow of "hi" gasoline which is desired to be taking place through line 25 (and meter 20) for the blend being dispensed; this flow would be the preset percent "hi" (set on switches 40) multiplied by the total flow of both of the blending components (represented by the summed, total-quantity pulses).

The pulses selected by the arrangement 40, 41 appear at the output 43 of the circuit 41 and are fed as one of the two inputs to a differential comparison circuit and motor drive unit 44. The other input to the comparison circuit is obtained at 24 from the "hi" pulse generator 22; it should be understood that the pulse repetition rate in the output of generator 22 is directly proportional to the actual flow of "hi" gasoline through the meter 20.

Output from unit 44 is fed to a stepping motor 45 which mechanically drives as at 46 a double-acting cam 47 which simultaneously actuates the "lo" valve 13 and the "hi" valve 27, but in opposite senses.

Operation of the automatic blend control portion of the dispensing apparatus will now be explained. During dispensing of any one of the blends A, B or C, the "desired flow" pulses appearing at 43 are differentially compared (in unit 44) with the "actual flow" pulses appearing at 24; if the pulses from 41 and 22 do not appear alternately and one at a time at unit 44, the motor drive in unit 44 energizes the motor 45 to adjust the positions of the blend control valves (proportioning valves) 13 and 27 to reduce this difference to substantially zero, thereby to maintain the desired proportion of "hi" gasoline in the blend. If the "actual flow" of "hi" gasoline (through meter 20) is less than the "desired flow" (i.e., the preset percentage of the total flow of both liquids), motor 45 is energized to actuate "hi" valve 27 toward the fully open position, and to actuate "lo" valve 13 toward the fully closed position. If, on the other hand, the "actual flow" of "hi" gasoline is in excess of the "desired flow", motor 45 is energized to actuate "hi" valve 27 toward the fully closed position, and to actuate "lo" valve 13 toward the fully open position.

The first step in the recommended procedure for the operation of the dispensing apparatus of the invention would be the removal of the dispensing nozzle from its rest or storage position, for example in a "boot" formed in the outside of the apparatus housing. As will be later detailed, this automatically puts into operation a start-up sequencer, which effects certain resetting and enabling operations, including the enabling of the "blend select" pushbuttons (switches) 29 (which latter might be more aptly termed "grade select" switches, since the product selected for dispensing may be solely one of the components, rather than an actual blend).

The second step in the standard operating procedure for the dispensing apparatus would be the selection of a product for dispensing by operating the appropriate pushbutton 29. When the selected pushbutton has been actuated, the pumps 1 and 15 are started, the gallons 32 and dollars 37 counters are reset (as will be explained), and in addition a pre-position control circuit 48 is enabled, as indicated by the connection 49. The circuit 48 operates through the motor drive unit 44 to energize the stepping motor 45 in such a way as to pre-position the control valves 13 and 27 in accordance with the particular grade of gasoline desired to be dispensed. Once this pre-positioning has been effected, gasoline is pumped through one or both of the lines 11 and 25.

At the end of each dispensing operation, the nozzle is returned to its rest position. This automatically turns off the pumps 1 and 15 and operates the valves 13 and 27 to their "off" or fully closed positions, as will be explained further hereinafter.

All of the apparatus previously described in connection with FIG. 1 is electronic, except of course the actual pumps 1 and 15, the motor-cam arrangement 45–47, and the blend control valves 13, 27. All of the calculation, display, and control operations utilize digital logic circuitry.

Refer again to FIG. 1 for additional details of the "lo" pulse generator 8; the "hi" pulse generator 22 is very similar so will not be described in detail. The volumetric meter 6 is provided with an output shaft 7 the rotations of which correspond to the quantity of fuel delivered (i.e., dispensed); purely by way of example, eight rotations of the shaft correspond to one gallon delivered. The output shaft 7 drives the pulse generator 8 to produce one thousand pulses per gallon. A perforated disc 50 is driven by the meter output shaft 7 through a gear drive having a step-up ratio of 2.5 to 1, so that the disc rotates through 20 revolutions for each gallon of "lo" fuel measured by meter 6. The disc has 50 equally spaced holes therein near its periphery, but is otherwise imperforate, and is arranged to interrupt a beam of light passing from a lamp 51 to a photocell 52 the pulsating output of which (1000 pulses per gallon of liquid flowing through meter 6) is fed via coupling 9 to the adder 10. Preferably, the lamp 51 is a light-emitting diode (LED) and the photocell 52 is a phototransistor; both of these items are contained in a single housing of U-shaped configuration which surrounds the edge of the disc.

Figure 2:
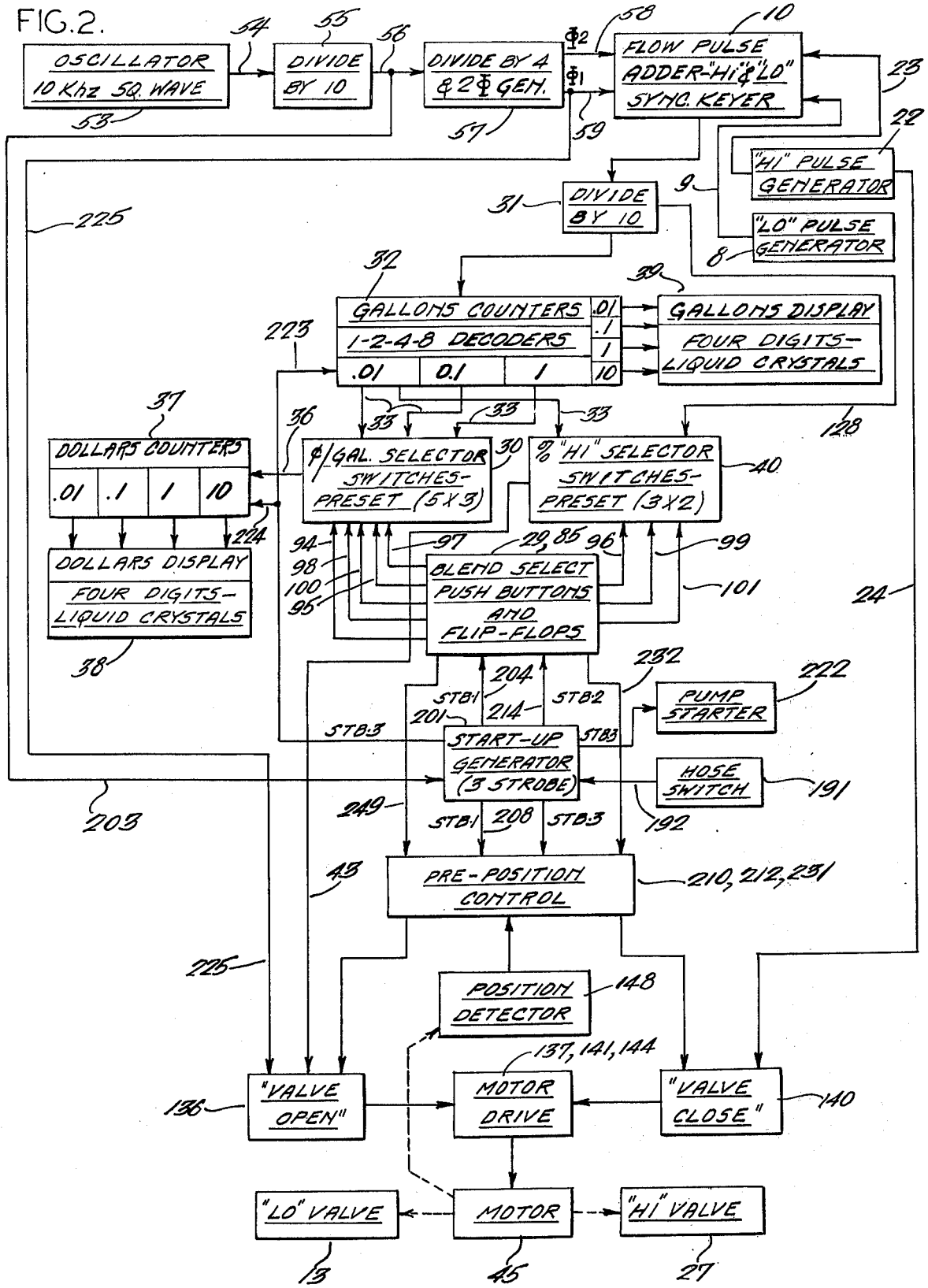
FIG. 2 is a block diagram illustrating the electronic circuitry utilized in the dispensing apparatus of this invention.

Refer now to FIG. 2, which is a representation in block diagram form of the electronic circuitry involved in the apparatus of this invention. An oscillator 53, which is energized continuously regardless of whether or not the apparatus is actually being used for dispensing, generates a 10 kHz square wave which appears at the oscillator output 54. The square wave output of the oscillator is divided by ten in a unit 55, which may be a conventional binary/decimal counter with the connection 54 coupled to the "clock" terminal of the counter, the 1 kHz square wave output of unit 55 then appearing on a lead 56 connected to the "carry out" terminal of such unit.

Lead 56 feeds the output of unit 55 to a combination divide-by-four and two-phase generator 57, which may comprise a pair of flip-flops of the toggle, trigger, or complementary type connected in cascade, the two-phase output leads 58 ($\Phi 2$) and 59 ($\Phi 1$) being connected to the respective outputs of the second flip-flop. The elements 53, 55, and 57 together comprise a 250 Hz two-phase generator which produces pulses at the rate of 250 Hz. The outputs of the second flip-flop are gated with the input to that flip-flop, so that the two-phase pulses are separated in time.

Figure 3:
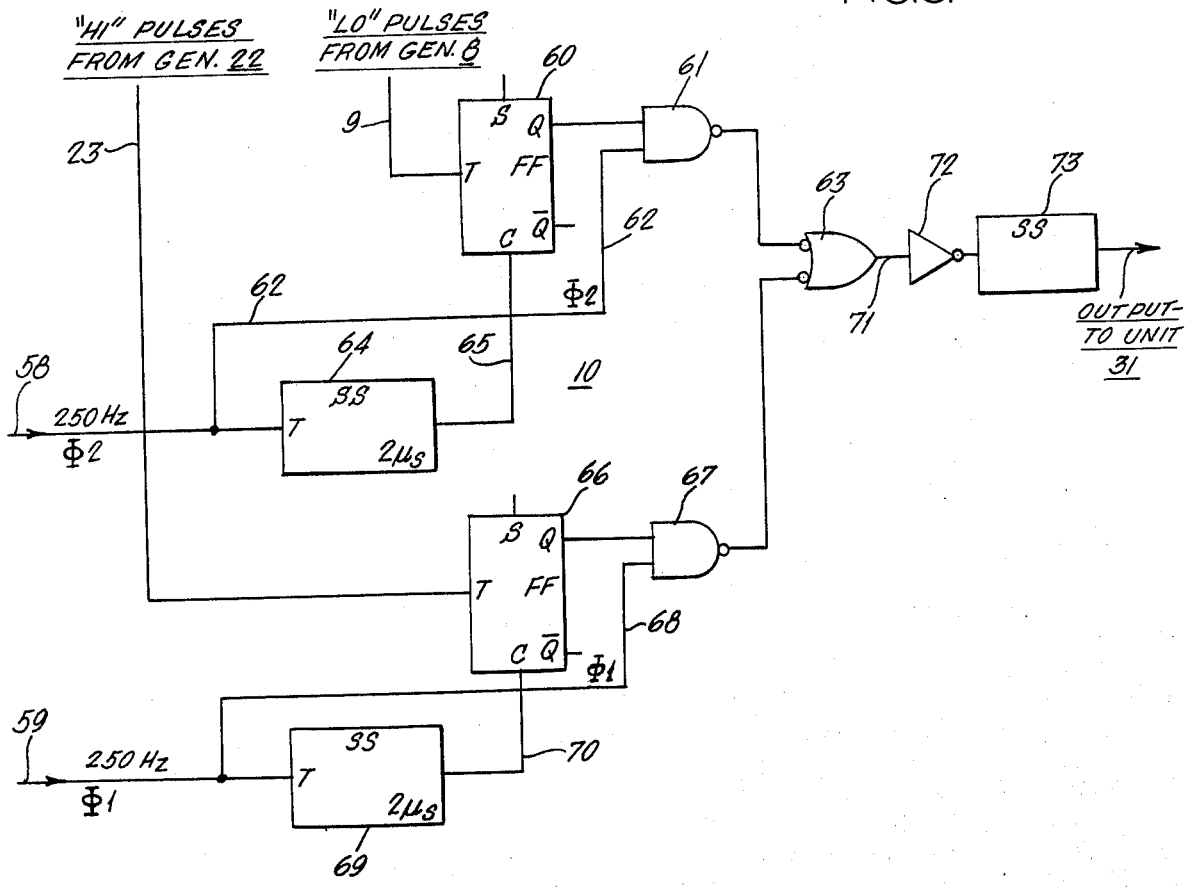
FIG. 3 is a logic diagram of a flow pulse adder and synchronized keyer utilized in this invention.

Refer now to FIG. 3, which is a logic diagram of the flow pulse adder and "hi" and "lo" synchronized keyer 10. During dispensing, the "lo" pulses from the "lo" pulse generator 8 (produced at the rate of 1000 pulses per gallon of liquid flowing through the meter 6) appear on lead 9, and are applied to the toggle (trigger) input T of a flip-flop 60 one of whose outputs is connected to one of the two inputs of an AND circuit 61 with logic negation at its output. Keying pulses (250 Hz, $\Phi 2$) are taken off from lead 58 by way of lead 62 and utilized as the other input for the AND 61. Each pulse coming in from the pulser 8 reverses the state of the flip-flop 60, and this reversal of state is transferred over to the OR circuit 63 at the time of occurence of the next keying pulse appearing on lead 62. The 250 Hz pulses, $\Phi 2$, are applied to the input of a single shot (one shot) 64, which produces for each input pulse an output pulse of very short duration (e.g., 2 microseconds); these latter pulses are applied by way of lead 65 to the clear (reset) input C of the flip-flop 60, to reset this flip-flop at the 250 Hz frequency. The flip-flop 60 is always reset before another pulse from pulser 8 can be present.

The "hi" pulses from the "hi" pulse generator 22 appear on lead 23 during dispensing, and are applied to the toggle input T of a flip-flop 66 one of whose outputs is connected to one of the two inputs of an AND circuit 67 with logic negation at its output. Keying pulses of the other phase (250 Hz, $\Phi 1$) are taken off from lead 59 by way of lead 68 and utilized as the other input for the AND 67. Each pulse coming in from the pulser 22 reverses the state of the flip-flop 66, and this reversal of state is transferred over to the OR circuit 63 at the time of occurrence of the next keying pulse appearing on lead 68. The 250 Hz pulses, $\Phi 1$, are applied to the input of a single shot (one shot) 69, which produces for each input pulse an output pulse of very short duration e.g., 2 microseconds); these latter pulses are applied by way of lead 70 to the clear (reset) input C of the flip-flop 66, to reset this latter flip-flop at the 250 Hz frequency. The flip-flop 66 is always reset before another pulse from pulser 22 can be present.

The result of the action described above is to produce in the OR output 71 a train or succession of pulses which is the sum of the pulses produced by the two pulse generators 8 and 22, this sum representing the combined flow of "lo" and "hi" gasolines through both meters 6 and 20. It may be here noted that since the keying pulses supplied at 62 and 68 to the AND circuits 61 and 67 are obtained from respective opposite phases of a two-phase source, the AND circuits 61 and 67 will never emit simultaneously any pulses to the OR 63. There is thus no necessity for the provision of any "anti-coincidence" arrangement of the type frequently used in other apparatus to avoid improper counting when pulses may be emitted simultaneously.

The pulse train output at 71, representing the sum total from the "hi" and "lo" pulsers 22 and 8, respectively, is passed through an inverter 72 and is then applied to the input of a single shot 73, which produces for each input pulse an output pulse of rather short duration (e.g., about 1 millisecond), and thus acts as a pulse shaper. The narrow-pulse output from the one shot 73 is fed into the divide-by-ten circuit 31 (FIGS. 1 and 2), and thence into the cost and quantity calculating units.

Refer now to FIG. 4, which is a logic diagram, in somewhat simplified form, of the gallons counters 32, the associated BCD (Binary Coded Decimal) decoders, and the gallons display 39. The train of narrow (short-duration) pulses from the pulse adder 10, which represents the summed pulses from the two pulsers 8 and 22, is applied to the input (CL) of an IC 31, which can function as a counter (divide by ten) and seven-segment decode. The output terminals of unit 31 are connected to the OR-AND logic arrangement enclosed by the dotted-line box 74, which functions as a BCD non-coincidental decoder, producing from the summed, divided-by-ten pulse output of unit 31, 1-2-4-8 binary coded signals, which appear at the correspondingly-labeled leads 75, 76, 77, and 78, respectively. These latter leads are cabled at 128 to supply such coded signals to the most significant digit (of the two digits) of all three of the % "hi" selector switches 40. The line (lead) 79 provides the decode carry-out (i.e., the zero) for the decoder 74, and also provides pulse width control.

Refer now to FIG. 5, the upper portion of which is a timing diagram illustrating the coding arrangement of the 1-2-4-8 pulses appearing on the leads 75–78, referred to a timing wave denoted as "clock". This illustrates the non-coincidental arrangement of the pulses. For the numeral "1", one pulse would be selected by using lead 75 alone. For numeral "2", lead 76 would be used alone; although the pulses on this lead occur at the same time as some of the pulses on lead 78, these two leads are never used simultaneously. For numeral "3", leads 75 and 76 are used together; the respective pulses are non-coincidental. For numeral "4", lead 77 would be used alone; it may be noted that leads 77 and 78 are never used simultaneously. For numeral "5", leads 75 and 77 are used together; the respective pulses are non-coincidental. For numeral "6", leads 76 and 77 are used together; the respective pulses are non-coincidental. For numeral "7", leads 75, 76, and 77 are used together; the respective pulses are non-coincidental. For numeral "8", lead 78 is used alone. For numeral "9", leads 75 and 78 are used together; the respective pulses are non-coincidental.

The 1-2-4-8 coding arrangement just described in connection with FIG. 5, is used for both the price selector switches 30 and the percent "hi" selector switches 40. This will be further explained hereinafter.

From the carry-out terminal of unit 31, a lead extends through a carry-out circuit 81 (not detailed) to the input (CL) of a second IC $32_1$, which functions as a counter (divide by ten) and a seven-segment decode and is preferably of the same construction as IC 31. The output terminals of unit $32_1$ are connected to the BCD non-coincidental decoder $74_1$, which is exactly similar to unit 74. The 1-2-4-8 coded signals produced from the decade-divided output of unit $32_1$ (a description similar to that of FIG. 5 would apply here also) are cabled at $33_1$ to supply such coded signals to the least significant digit of all three of the % "hi" selector switches 40, and also to the most significant digit (of the three digits) of all five of the cents per gallon (price) selector switches 30.

The seven segment decode connections of the IC $32_1$ are coupled through an EXCLUSIVE OR display coupling circuit 80 to the seven segments of a so-called liquid crystal digit $39_1$ representing hundredths of gallons. The scheme for energizing these segments is illustrated in the lower portion of FIG. 5, taken in conjunction with the key in FIG. 6; the energization scheme is for the respective decimal digits given above the "clock" wave at the top of FIG. 5 and a segment waveform extending above the base line for that waveform indicating that the corresponding segment is energized.

From the carry-out terminal of unit $32_1$, a lead 82 extends to the input (CL) of a third IC $32_2$, which functions as a counter (divide by ten) and seven-segment decode and is preferably of the same construction as IC 31. The output terminals of unit $32_2$ are connected to the BCD non-coincidental decoder $74_2$, which is exactly similar to unit 74. The 1-2-4-8 coded signals produced from the decade-divided output of unit $32_2$ are cabled at $33_2$ to supply such coded signals to the middle digit of all five of the price selector switches 30.

The seven segment decode connections of the IC $32_2$ are coupled through a display coupling circuit $80_1$ (similar to circuit 80) to the seven segments of a liquid crystal digit $39_2$ representing tenths of gallons. The digit display $39_2$ operates in the same manner as digit display $39_1$, previously described.

From the carry-out terminal of unit $32_2$, a lead 83 extends to the input (CL) of a fourth IC $32_3$, which functions as a counter (divide by ten) and seven-segment decode and is preferably of the same construction as IC 31. The output terminals of unit $32_3$ are connected to the BCD non-coincidental decoder $74_3$, which is exactly similar to unit 74. The 1-2-4-8 coded signals produced from the decade-divided output of unit $32_3$ are cabled at $33_3$ to supply such coded signals to the least significant digit of all five of the price selector switches 30.

The seven segment decode connections of the IC $32_3$ are coupled through a display circuit $80_2$ (similar to circuit 80) to the seven segments of a liquid crystal digit $39_3$ representing gallons. The digit display $39_3$ operates in the same manner as digit display $39_1$, previously described.

From the carry-out terminal of unit $32_3$, a lead 84 extends to the input (CL) of a fifth IC $32_4$, which functions as a counter (divide by ten) and seven-segment decode and is preferably of the same construction as IC 31. The seven segment decode connections of the IC $32_4$ are coupled through a display coupling circuit (similar to circuit 80) to the seven segments of a liquid crystal digit $39_4$ representing tens of gallons. The digit display $39_4$ operates in the same manner as digit display $39_1$, previously described.

The net result of all the foregoing is that, during dispensing, the summed pulse output of the two flowmeters 6 and 20 (representing the total volume of fuel delivered) is counted, and displayed in four digits ( to hundredths of gallons) by the display devices $39_1 - 39_4$. A fixed decimal point is provided between the digits of $39_3$ and $39_2$; this decimal point may be painted on the outside of the housing. (In this connection, it is pointed out that the digits of the liquid crystal display $39_1$–$39_4$ are located so as to be visible through suitable openings provided in the dispensing apparatus housing.) Also, it may be noted that the total-flow pulses are coded in binary fashion for supply (by cables 128 and $33_{1\text{-}3}$) to the selector switches 30 and 40.

Refer now to FIG. 7, which is a circuit schematic of the blend select, % "hi" select, and price select portions of the system. The five "blend select" pushbuttons $29_1$, $29_2$, $29_3$, $29_4$, and $29_5$ (one for each of the five grades which may be dispensed) are located at the right-hand side of this figure. In this connection, it is noted that the term "blend select" is used herein for these pushbuttons because this term has become more familiar in the art; actually, the term "grade select" would be more appropriate since two of the grades which may be selected (to wit, solely "hi" gasoline, and solely "lo" gasoline) are of course not "blends".

The blend select pushbuttons $29_1$–$29_5$ are preferably individual single-pole, single-throw switches, normally open but manually operated to a closed position when a blend selection is made by the operator of the apparatus. They are mounted for operation from outside the apparatus housing, and are associated with the various grades, as follows: pushbutton $29_1$, "hi" or "super premium"; pushbutton $29_2$, "Blend A" or "premium"; pushbutton $29_3$, "Blend B" or "super regular"; pushbutton $29_4$, "Blend C" or "regular"; pushbutton $29_5$, "lo" or "economy regular".

Blend select flip-flops $85_1$–$85_5$ (actually, each may be a so-called flip-flop complementary) are individually associated with the pushbuttons $29_1$–$29_5$, respectively. When one of the pushbuttons $29_1$–$29_5$ is operated, a strobe voltage (denoted by STB 2, and derived as described hereinafter) is supplied through the operated pushbutton to the toggle (or trigger) T of the corresponding flip-flop $85_1$–$85_5$, reversing the state of this flip-flop.

A plurality of transfer gates 86–93 (solid-state switches) are associated with the various flip-flops $85_1$–$85_5$, to be operated by the latter. The gates 86–93 operate as series on-off switches operated by the flip-flops $85_1$–$85_5$, each switch being closed or turned on (and then having a low series resistance between the gate input and the gate output) when the associated flip-flop is reversed in state, and being opened or turned off (and then having in effect a very high series resistance between the gate input and the gate output) at all other times.

When the flip-flop $85_1$ is reversed in response to the operation of pushbutton $29_1$, the "price" gate 86 is operated to connect its price pulse input 94 to a common price pulse output 36. When the flip-flop $85_2$ is reversed in response to the operation of pushbutton $29_2$, the "percent" gate 87 is operated to connect its % pulse input 96 to a common % "hi" pulse output 43; also, the "price" gate 88 is operated to connect its price pulse input 98 to the common price pulse output 36. When the flip-flop $85_3$ is reversed in response to the operation of pushbutton $29_3$, the "percent" gate 89 is operated to connect its % pulse input 99 to the common % output 43; also, the "price" gate 90 is operated to connect its price pulse input 100 to the common price pulse output 36. When the flip-flop $85_4$ is reversed in response to the operation of pushbutton $29_4$, the "percent" gate 91 is operated to connect its % pulse input 101 to the common % output 43; also, the "price" gate 92 is operated to connect its price pulse input 95 to the common price pulse output 36. Finally, when the flip-flop $85_5$ is reversed in response to the operation of pushbutton $29_5$, the "price" gate 93 is operated to connect its price pulse input 97 to the common price pulse output 36.

As previously mentioned, the cents per gallon (i.e., the price) selector switches 30 comprise five sets (one set for each of the grades or products which may be dispensed) of three switches each, one switch representing tens of cents, the second representing cents, and the third, tenths of cents. These switches are thumbwheel-operated switches (5 × 3, or 15 in all) which are individually operable and are so located as to be accessible to the service station operator (dealer). Each switch is provided with indicia consisting of the numerals zero through nine, inclusive, which indicia are visible (one numeral at a time, of course, for each wheel) through openings in the dispensing apparatus housing. The three price selector switches 30 for each particular grade of product are located, physically, adjacent the pushbutton 29 for that same product, so that, by looking at the visible indicia on the switches, the customer can easily determine what price (in cents per gallon) has been pre-established for each respective product.

Assume, for purposes of discussion, that pushbutton $29_2$ has been operated to select Blend A for dispensing, and that the price of this product is 27.9 cents per gallon (as previously stated, it may be priced anywhere within the range of 0.1 cents to 99.9 cents per gallon). When pushbutton $29_2$ is operated, the price pulse input lead 98 is connected to the common price pulse output 36.

Refer now to FIGS. 8 and 9, which illustrate the construction of the set of price selector switches $30_1$, $30_2$, and $30_3$ for Blend A. This set of switches may be considered typical of all five sets. Referring again to FIG. 7, the output sides of the three price selector switches for the "hi" gasoline are all coupled to the price pulse input lead 94 for "hi" gasoline; the output sides of the price selector switches $30_1$, $30_2$, and $30_3$ are all coupled to the price pulse input lead 98 for Blend A; the output sides of the three price selector switches for Blend B are all coupled to the price pulse input lead 100 for Blend B; the output sides of the three price selector switches for Blend C are all coupled to the price pulse input lead 95 for Blend C; the output sides of the three price selector switches for the "lo" gasoline are all coupled to the price pulse input lead 97 for the "lo" gasoline.

FIG. 8 is a plan view of the price selector switch arrangement $30_1$ – $30_3$ with the price wheels removed, while FIG. 9 is a front elevation, with certain portions in cross-section. The three thumbwheel switches $30_1$, $30_2$, and $30_3$ are mounted in side-by-side relationship on a printed circuit board denoted generally by numeral 102. The 1-2-4-8 binary pulses from decoder $74_1$ are fed to the first switch $30_1$ (in FIG. 8, these pulses are denoted as 10-20-40-80 to indicate that the selection made by this particular switch represents tens of cents). The "40" pulses (corresponding to the line labeled "lead 77" in FIG. 5) are fed through a diode D1, poled as indicated, to a conductive strip 104 of arcuate configuration with an arrangement or pattern of spaced radially-extending teeth or projections thereon; the conductive strip 104, like others to be described, is formed on one surface of the board 102. The "10" pulses (corresponding to the line labeled "lead 75" in FIG. 5) are fed through a diode D2 to a conductive strip 106 of arcuate configuration with an arrangement or pattern of spaced radially-extending teeth or projections thereon. The "20" pulses (corresponding to the line labeled "lead 76" in FIG. 5) are fed through a diode D3 to a conductive strip 108 of arcuate configuration with an arrangement or pattern of spaced radially-extending teeth or projections thereon. The "80" pulses (corresponding to the line labeled "lead 78" in FIG. 5) are fed through a diode D4 to a conductive strip 110 of arcuate configuration with an arrangement or pattern of spaced radially-extending teeth or projections thereon.

All of the conductive strips 104, 106, 108, and 110 are centered at the center of a hole 111 which is provided in the board 102 for mounting of the thumbwheel 112 (see FIG. 9), which latter cooperates with the said conductive strips. The thumbwheel (price wheel) 112, although omitted from FIG. 8, is mounted for rotation about an axis perpendicular to the plane of the paper in FIG. 8. The wheel 112 is made of an electrically insulating material, this wheel having attached thereto four spring contacts or fingers 113 (see FIG. 9) which are connected together electrically and which are arranged to slide over the board 102 and to make contact selectively with the conductive strips 104, 106, 108, and 110.

In addition to the conductive strips 104, 106, 108, and 110, there is provided on board 102 an additional conductive area 114 which provides a common output connection for all three selector switches $30_1$–$30_3$ of the set, and which has separate arcuate portions associated with each respective one of the three thumbwheels of the set. The spring contacts or fingers 113 also make contact selectively with the conductive area 114. At the terminal side of the board 102 (upper edge in FIG. 8), the conductive area 114 is connected to the price pulse input lead 98 for the gate/switch 88 (see FIG. 7). Also, it may be noted that the four diodes D1, D2, D3, and D4 (for switch $30_1$) are illustrated in FIG. 7.

The price wheel 112 carries the numerals 0 through 9 around its periphery (see FIG. 9 for the illustration of this on the similar wheels for switches $30_2$ and $30_3$), and is provided with a detenting means (schematically illustrated at 116 in FIG. 8) for indexing the wheel to any one of its ten positions, 36° apart. In FIG. 8, the locations on the board 102 of the contacts 113 are indicated at 115, and the electrical interconnection thereof is illustrated by means of a dotted line. The locations of the contact points 115, as well as the layout of the conductive strips 104, 106, 108, 110, and 114, are made such that, as thumbwheel 112 is rotated to its various positions, the appropriate number of pulses is selected (from the 1-2-4-8 input binary pulses supplied thereto) in accordance with the scheme set forth hereinabove (in connection with FIG. 5), and is fed to the output (area 114, lead 98, gate 88).

In FIG. 8, the first thumbwheel 112 (described in detail) is illustrated in the "2" position, a setting corresponding to a digit 2 in the tens place of the price per gallon in cents. In this position, one of the contact points 115 engages the "20" pulse strip 108, and another engages the common output area 114, which means that of the pulses in the output of the decoder $74_1$, two pulses out of every ten will be delivered to the line 98.

The 1-2-4-8 binary pulses from decoder $74_2$ are fed to the second switch $30_2$ (in FIG. 8, these pulses are denoted as 1-2-4-8 to indicate that the selection made by this particular switch represents cents). The construction, connection, and mode of operation of the second switch $30_2$ are all very similar to those of the first switch $30_1$ previously described, so the same reference numerals are employed. In switch $30_2$, the "4", "1", "2", and "8" connections correspond respectively to the "40", "10", "20", and "80" connections in switch $30_1$.

In FIGS. 8-9 the second thumbwheel (i.e., the one for the second switch $30_2$) is illustrated in the "7" position, corresponding to seven cents. In this position, one of the contact points 115 engages the "4" pulse strip 104, a second engages the "1" pulse strip 106, a third engages the "2" pulse strip 108, and the fourth engages the common output area 114, which means that of the pulses in the output of the decoder $74_1$, seven pulses out of every hundred will be delivered to the line 98 (since only every tenth pulse entering the unit $32_2$ will enter the unit $74_2$).

The 1-2-4-8 binary pulses from decoder $74_3$ are fed to the third switch $30_3$ (in FIG. 8, these pulses are denoted as 0.1-0.2-0.4-0.8 to indicate that the selection made by this particular switch represents tenths of cents). Again, the construction, connection, and mode of operation of the third switch $30_3$ are all very similar to those of the first switch $30_1$, so the same reference numerals are employed. In switch $30_3$, the "0.4", "0.1", "0.2", and "0.8" connections correspond respectively to the "40", "10", "20", and "80" connections in switch $30_1$.

In FIG. 8–9, the third thumbwheel (i.e., the one for the third switch $30_3$) is illustrated in the "9" position, corresponding to 0.9 cent. In this position, one of the contact points 115 engages the "0.8" pulse strip 110, another engages the "0.1" pulse strip 106, and a third engages the common output area 114, which means that of the pulses in the output of the decoder $74_1$, nine pulses out of every thousand will be delivered to the line 98 (since only every tenth pulse entering the unit $32_3$ will enter the unit $74_3$).

The above means (assuming that the switches $30_1$–$30_3$ are set to 27.9 cents per gallon) that for every 1000 pulses appearing in the output of the flow pulse adder 10, 279 pulses will be selected (by the selector switches 30) and passed (by way of lead 98 and switch 88, assuming Blend A has been selected for dispensing by actuation of pushbutton $29_2$) to the price pulse output lead 36. Speaking more generally, there will appear on the price pulse output lead 36, for each delivery of fuel, a total number of pulses representing the product of the quantity of gasoline (in gallons) delivered (which is proportional to the cumulative pulse output of the pulse adder 10) and the price of the gasoline (in cents per gallon, as preset on whichever set of selector switches is operative for the delivery). The theory of operation of this pulse selection-multiplication process is explained more fully in Livesay U.S. Pat. No. 3,081,031, Mar. 12, 1963.

As previously stated, there are provided five sets of price selector switches 30, one set for each of the five grades of gasoline which may be selected for dispensing. One set of such switches (to wit, that for Blend A) has been described in detail in connection with FIGS. 8 and 9. These sets of switches are all supplied with pulses similarly, and all are constructed and operate like switches $30_1$–$30_3$. In FIG. 7, the commoned outputs (that is, the output area corresponding to 114 in FIG. 8) of the uppermost set of price switches 30 are connected to price pulse input lead 94, and these switches are set manually to establish the price per gallon for the "hi" gasoline; the outputs of the next set of switches (switches $30_1$–$30_3$) are commoned to price pulse input lead 98, and these switches are set manually to establish the price per gallon for Blend A; the outputs of the next lower set of switches are commoned to price pulse input lead 100, and these switches are set manually to establish the price per gallon for Blend B; the outputs of the next lower set of switches are commoned to price pulse input lead 95, and these switches are set manually to establish the price per gallon for Blend C; the outputs of the next lower set of switches are commoned to price pulse input lead 97, and these switches are set manually to establish the price per gallon for the "lo" gasoline.

As previously explained, the total number of pulses which appear on the price pulse output lead 36 during dispensing represents the product of the total volume or quantity of gasoline delivered and the unit price (in cents per gallon), which product of course is the total cost of the gasoline dispensed. These pulses are counted and displayed by means of the circuit arrangement of FIG. 10, now to be described.

The pulses appearing on the price pulse output lead 36 are applied to the input (CL) of an IC $37_1$, which functions as a counter (divide by ten) and seven-segment decode. The seven segment decode connections of the IC $37_1$ are coupled through a display coupling circuit $130_1$ (similar to coupling circuit 80, previously described) to the seven segments of a liquid crystal digit $38_1$ representing hundredths of dollars. The scheme for energizing these segments is exactly similar to that previously described in connection with digit $39_1$.

From the carry-out (CO) terminal of unit $37_1$, a lead 131 extends to the input (CL) of a second IC $37_2$, which functions as a counter (divide by ten) and seven-segment decode, and is preferably of the same construction as IC $37_1$. The seven segment decode connections of the IC $37_2$ are coupled through a display coupling circuit $130_2$ (similar to circuit $130_1$) to the seven segments of a liquid crystal digit $38_2$ representing tenths of dollars. The digit display $38_2$ operates in the same manner as digit display $38_1$ previously described.

From the carry-out terminal of unit $37_2$, a lead 132 extends to the input of a third IC $37_3$, which functions as a counter (divide by ten) and seven-segment decode and is preferably of the same construction as IC $37_1$. The seven segment decode connections of the IC $37_3$ are coupled through a display circuit $130_3$ (similar to circuit $130_1$) to the seven segments of a liquid crystal digit $38_3$ representing dollars. The digit display $38_3$ operate in the same manner as digit display $38_1$, previously described.

From the carry-out terminal of unit $37_3$, a lead 133 extends to the input of a fourth IC $37_4$, which functions as a counter (divide by ten) and seven-segment decode and is preferably of the same construction as IC $37_1$. The seven segment decode connections of the IC $37_4$ are coupled through a display circuit $130_4$ (similar to circuit $130_1$) to the seven segments of a liquid crystal digit $38_4$ representing tens of dollars. The digit display $38_4$ operates in the same manner as digit display $38_1$, previously described.

Thus, during dispensing, the pulses appearing on the price pulse output lead 36 (which represent the total cost of the gasoline delivered or dispensed) are counted, and displayed in four digits (to hundredths of dollars, that is, cents) by the display devices $38_1$–$38_4$. A fixed decimal point is provided between the digits of $38_2$ and $38_3$; this decimal point may be painted on the outside of the dispensing apparatus housing. (In this connection, it is pointed out that the digits of the liquid crystal display $38_1$–$38_4$ are located so as to be visible through suitable openings provided in the housing.)

Refer again to FIG. 7. As mentioned hereinabove, the % "hi" selector switches 40 comprise three sets (one set for each of the three blends A, B, and C which may be dispensed) of two switches each, one switch representing tens of percent and the other, units of percent. These switches are manually-operable (rotatable) switches (3 × 2, or six in all) which are individually operable and are so located (for example, within a locked enclosure) as to be accessible only to authorized maintenance personnel (not to the service station operator or dealer). Each rotatable switch wafer is provided with indicia consisting of the numerals zero through nine, inclusive.

Again assume that pushbutton $29_2$ has been operated to select Blend A for dispensing, and that the percentage of "hi" gasoline in this blend is 63 (as previously stated, it may be set anywhere within the range of 1% to 99%, in steps of 1%). When pushbutton $29_2$ is operated, the % pulse input lead 96 is connected to the common % pulse output 43.

Refer now to FIG. 11, which illustrates the construction of the set of % switches $40_1$, $40_2$ for Blend A. This set of switches may be considered typical of all three sets. Referring again to FIG. 7, the output sides of the two % selector switches $40_1$, $40_2$ are both coupled to the % pulse input lead 96 for Blend A; the output sides of the two % selector switches for Blend B are both coupled to the % pulse input lead 99 for Blend B; the output sides of the two % selector switches for Blend C are both coupled to the % pulse input lead 101 for Blend C.

FIG. 11 is a plan view (somewhat schematic) of the % selector switch arrangement $40_1$–$40_2$ with the diode-carrying rotatable wafer removed. The two switches $40_1$ and $40_2$ are mounted in side-by-side relationship on a printed circuit board (not detailed in FIG. 11). The 1-2-4-8 binary pulses from decoder 74 are fed to the first switch $40_1$ (in FIG. 11, these coded binary pulses are denoted as 10-20-40-80 to indicate that the selection made by this particular switch represents decade percents). The "40" pulses (as represented on "lead 77" in FIG. 5) are fed (by lead 77) to a conductive strip 117 of arcuate configuration which, like others to be described, would be formed on one surface of the circuit board. The "10" pulses (as represented on "lead 75" in FIG. 5) are fed (by lead 75) to a conductive strip 118 of arcuate configuration with an arrangement or pattern of spaced radially-extending teeth or projections thereon. The "20" pulses (as represented on "lead 76" in FIG. 5) are fed (by lead 76) to a conductive strip 119 of arcuate configuration with an arrangement or pattern of spaced radially-extending teeth or projections thereon. The "80" pulses (as represented on "lead 78" in FIG. 5) are fed (by lead 78) to a conductive strip 120 of arcuate configuration.

All of the conductive strips 117-120 are centered at the center of a hole 130 which is provided in the aforesaid board for mounting of a rotatable switch wafer (not shown) which cooperates with the said conductive strips. This wafer is mounted for rotation about an axis perpendicular to the plane of the paper in FIG. 11. The said wafer has attached thereto four spring contacts or fingers (represented by the contact points 121, 122, 123, and 124) which are arranged to make contact selectively with the conductive strips 117–120 and also with another conductive strip 125 formed as a complete ring or annulus and providing a common output connection for both selector switches $40_1$ and $40_2$ of the set, the strip 125 having also a second complete ring or annulus for the second switch $40_2$. The contact 124 continuously engages the output strip 125; this output strip is connected to the % pulse input lead 96 for the gate/switch 87 (see FIG. 7). The contact 121 is connected through a diode D5 (poled as illustrated, and mounted on the rotatable switch wafer) to contact 124; the contact 122 is connected through a diode D6, similarly mounted, to contact 124; the contact 123 is connected through a diode D7, similarly mounted, to contact 124. The three diodes D5–D7 (for switch $40_1$)

are illustrated in FIG. 7. The electrical interconnections of the four contacts 121–124 are illustrated by dotted lines.

The rotatable switch wafer for switch $40_1$ is provided with a detenting means (schematically illustrated at 129 in FIG. 11) for indexing the wafer to any one of its ten positions, 36° apart. The locations of the contacts 121–123, as well as the layout of the conductive strips 117–120, are made such that, as the rotatable wafer is rotated to its various positions, the appropriate number of pulses is selected (from the 1-2-4-8 input binary pulses supplied thereto) in accordance with the scheme set forth hereinabove, and is fed to the output (strip 125, lead 96, gate 87).

In FIG. 11, the first switch wafer (the one just described in detail, for switch $40_1$) is illustrated in the "6" position, a setting corresponding to a digit 6 in the decades place of the percent. In this position, contact 121 engages the "40" pulse strip 117 and contact 123 engages the "20" pulse strip 119, which means that of the pulses in the output of the decoder 74, six pulses out of every ten will be delivered to the line 96.

The 1-2-4-8 coded binary pulses from decoder $74_1$ are fed to the second switch $40_2$ (in FIG. 11, these pulses are denoted as 1-2-4-8 to indicate that the selection made by this particular switch represents units of percent). The construction, connection, and mode of operation of the second switch $40_2$ are all very similar to those of the first switch $40_1$ previously described, so the same reference numerals are employed. In switch $40_2$, the "4", "1", "2", and "8" connections correspond respectively to the "40", "10", "20", and "80" connections in switch $40_1$.

In FIG. 11, the second switch wafer is illustrated in the "3" position, corresponding to 3%. In this position, contact 122 engages the "2" pulse strip 119 and contact 123 engages the "1" pulse strip 118, which means that of the pulses in the output of the decoder 74, three pulses out of every hundred will be delivered to the line 96 (since only every tenth pulse entering the unit $32_1$ will enter the unit $74_1$).

The above means (if the switches $40_1$, $40_2$ are set to 63%) that for every 100 pulses appearing in the output of the flow pulse adder 10, 63 pulses will be selected (by the selector switches 40) and passed (by way of lead 96 and switch 87, assuming Blend A has been selected for dispensing by actuation of pushbutton $29_2$) to the % pulse output lead 43.

As previously stated, there are provided three sets of % selector switches 40, one set for each of the three blended products which may be selected for dispensing. One set of such switches (to wit, that for Blend A) has been described in detail in connection with FIG. 11. These sets of switches are all supplied with pulses similarly, and all are constructed and operate like switches $40_1$–$40_2$. The outputs of the % switches $40_1$–$40_2$ are commoned to % pulse input lead 96, and these switches may be preset manually to establish the desired percentage of "hi" gasoline in Blend A; the outputs of the next lower set of % switches (see FIG. 7) are commoned to % input pulse lead 99, and these switches may be preset manually to establish the desired percentage of "hi" gasoline in Blend B; the outputs of the next lower set of % switches are commoned to % input pulse lead 101, and these switches may be preset manually to establish the desired percentage of "hi" gasoline in Blend C.

Refer now to FIG. 12, which is a logic diagram of the motor control portion of the dispensing apparatus. First, the automatic control of the stepping motor 45 during dispensing of a blend will be described. As will be explained more in detail hereinafter, this motor functions, under blend-dispensing conditions, to automatically control (i.e., adjust) the "hi" and "lo" proportioning valves 13 and 27, respectively, in opposite senses, which is to say that as the "hi" valve 27 is moved toward its fully open position, the "lo" valve 13 is moved toward its fully closed position, and vice versa.

Assume, as before, that Blend A ("premium") has been selected for dispensing, by operation of the pushbutton $29_2$ (FIG. 7); however, the same description will apply to the dispensing of any other of the three possible blended products. During dispensing of a blend, as should be apparent, the pulses from the two flowmeter pulsers (pulse generators) are summed or added in adder 10, and the fraction (percentage) of these summed pulses selected for utilization by the % switches $40_1$, $40_2$ (e.g., 63%) appears on output line 43 (see FIG. 7). These % "hi" (reference) pulses are fed through a pair of NOR gates 134 and 135 (assumed for the present to be open; how this is brought about will be explained hereinafter) to the input T of a single shot (one shot) 136, which produces for each input pulse an output pulse of very short duration (e.g., 2 microseconds). Thus, the device 136 functions as a pulse shaper. The pulse output of 136 is fed as one of the two inputs to a logic unit 137 (enclosed by a dot-dash line) which operates as a level triggered flip-flop whose output (of one sense or the other, depending on which way the flip-flop has been operated) appears at point 138.

During dispensing of a blend, the pulses produced by the "hi" pulse generator 22 ("hi" flowmeter pulser) are fed by way of lead 24 through a NOR gate 139 (assumed for the present to be open; how this is brought about will be explained hereinafter) to the input T of a single shot (one shot) 140, exactly similar to the IC 136 and also operating as a pulse shaper. The pulse output of 140 is fed as the other input to the flip-flop unit 137.

As previously described in connection with FIG. 1, the stepping motor 45, through a mechanical coupling 46, drives a cam 47, which in turn operates the blend control valves (proportioning valves) 13 and 27. The constructional details of this cam and the valves will be set forth hereinafter. Looking at the face of the cam, clockwise rotation thereof may be termed the "ON" direction, or rotation away from the "OFF" direction. The single shot 136 may be termed the "clockwise" or "ON" device, since pulses appearing in its output will result in a clockwise rotation of the valve drive cam; the single shot 140 may be termed the "counterclockwise" or "OFF" device, since pulses appearing in its output will result in a counterclockwise rotation of the valve drive cam.

Pulses from the "on" device 136, applied to flip-flop 137, drive the latter to one state; pulses from the "off" device 140, applied to the flip-flop, reverse the state of the latter.

The flip-flop output point 138 is connected to the P/S input of a shift register 141 which in effect differentially compares the pulses from the two sources 136 and 140. Adjacent output terminals Q2 and Q3 of the register 141 are connected by way of the paired leads 142 and 143, respectively, to separate corresponding power transistors connected in a bidirectional motor drive circuit and included in block 144. The power transistors provide drive for the stepping motor 45 (included for illustrative purposes in block 144).

As long as the individual pulses are received by the flip-flop 137 in strict alternation from the two sources 136 and 140, the state of this flip-flop is reversed back and forth in a regular manner, there is no net pulse count, and no net shift occurs in the shift register 141. However, if two (or more) pulses are received from one source before one is received from the other, there will be an excess count and the flip-flop operation will change to produce a net shift in register 141, resulting in a change in the order in which the signals appear at Q2 and Q3. This causes the stepping motor 45 to step in one direction or the other (the direction depending upon the order in which the signals appear at Q2 and Q3), the degree of rotation of the motor depending on the number of pulses which are in excess. The motor, by adjusting the blend control valves 13 and 27, will eliminate the excess pulse count, by adjusting the actual flow of "hi" gasoline (measured by the "hi" pulser 22) to the desired percentage of the total flow (measured by the preset % "hi", as set by the % switches 40 operating on the total flow--that is, the summed pulses from both flowmeters).

Refer now to FIGS. 13–14, which illustrate the mechanical construction of the blend control valves and the actuator therefor, by means of which the automatic blend control action just described is made effective. The stepping motor 45, which is driven by the pulse comparision circuit during dispensing, as described (and which is also driven to pre-position the blend control valves, in a manner which will be described hereinafter), is mounted in a fixed support denoted generally by numeral 145. The motor output shaft 146 drives (through a geared connection) a cam shaft 147 which is journaled for rotation in the support 145. The output shaft 146, the geared connection, and the cam shaft 147 together comprise the mechanical coupling 46 (FIG. 1).

A slotted disc 148 (utilized in pre-positioning of the blend control valves, and to be later described in more detail) is fixedly secured to one face of the gear 149, the hub of the latter being pinned to cam shaft 147. The gear 149 meshes with a gear pinned to the motor output shaft 146, and serves to drive the cam shaft 147.

The cam 47 has an integral hub at its center which is pinned to shaft 147, thereby to secure the cam to this shaft. Cam 47 has in its outer face a single continuous camming groove, denoted generally by numeral 150, in which ride a pair of rollers 151 and 152 which are located diametrically opposite each other (with respect to the cam shaft 147). Roller 151 is rotatably carried by the central portion of a lever 153 which is pivotally attached at one end to a fixed pivot (pin, or screw) 154 secured to the support 145. Roller 152 is rotatably carried by the central portion of a lever 155 which is pivotally attached at one end to a fixed pivot (pin, or screw) 156 secured to the support 145. One end of a link 157 is pivotally attached to the free end of lever 153, for adjustment of the "hi" valve 27; one end of a link 158 is pivotally attached to the free end of lever 155, for adjustment of the "lo" valve 13.

In FIGS. 13 and 14, the cam 47 and the valve actuating mechanism 151, 152, 153, 155, etc. are illustrated in the "OFF" position, wherein the valves 13 and 27 are both fully closed. From this position, rotation of the cam 47 in the clockwise direction (indicated by the arrow 159 labeled "ON", the clockwise direction referring to the direction of rotation when looking at the face of the cam, as in FIG. 13) causes opening of the valves, as will be described. From this "OFF" position, movement of the outer or free end of lever 153 through the clockwise arc 160 causes the "hi" valve 27 to be opened, and movement of the outer or free end of lever 155 through the clockwise arc 161 causes the "lo" valve 13 to be opened.

In the "OFF" position illustrated, roller 151 engages one end of the camming groove 150, thus limiting the rotation of the cam in the counterclockwise or "OFF" direction. In the opposite or "ON" position (180° from the position illustrated), roller 152 will engage the end 163 of the camming groove, thus limiting the rotation of the cam in the clockwise or "ON" direction.

For about the first 80° of rotation (in the "ON" direction 159) of the cam 47, from the "OFF" position, the groove 150 has a portion **150*a* (for the roller 152) which decreases in radius (measured from the center 162 of shaft 147) from a maximum to a minimum in continuous fashion, causing the lever 155 to swing through arc 161 during this angular rotation of the cam 47; this results in gradual opening of the "lo" valve 13, so that this valve is fully open at the end of this 80° of rotation of the cam. Opposite this portion 150*a*, the groove 150 has a "dwell" portion 150*b* (of constant radius) for the roller 151, so that lever 153 does not move during this interval; thus, the "hi" valve 27 remains fully closed during this initial 80° (from the "OFF" position) of rotation of cam 47.**

Immediately following the portion **150*a* (that is, beginning at the end of the initial 80° arc of rotation of the cam 47) the groove 150 has a relatively short (about 11°) portion 150*c*, for roller 152, which is a "dwell" portion (of constant radius), so that during this next 11° of cam rotation, the lever 155 remains stationary and the "lo" valve 13 remains fully open. Following this portion 150*c*, the groove 150 has a portion 150*d*, for roller 152, which increases in radius in continuous fashion from a minimum radius (portion 150*c*) to a maximum radius (at the end 163 of the camming groove). The portion 150*d* of the camming groove 150, which may be termed the "blend portion " for the "lo" valve 13, causes the lever 155 to swing through arc 161 but in the reverse direction from its initial swing; this results in gradual closing of the "lo" valve 13, so that this latter valve is fully closed when roller 152 reaches end 163 of the camming groove (that is, when the cam 47 has moved through its full arc of 180° in the clockwise direction, from the "OFF" position illustrated in FIG. 13). The terminal position mentioned, wherein roller 152 is at the groove end 163, may be termed the "ON" position of the cam 47.**

Following the portion **150*b*, the groove 150 has a portion 150*e*, for roller 151, which increases in radius in continuous fashion from a minimum radius (portion 150*b*) to a maximum radius, at radial line 164. The portion 150*e*, which may be termed the "blend portion" for the "hi" valve 27, causes the lever 153 to swing through arc 160; this results in gradual opening of the "hi" valve 27, so that this latter valve is fully open when the radial line 164 of the cam comes into registry with the center of roller 151. Finally, immediately following the portion 150*e*, the groove 150 has a relatively short (about 21°) portion 150*f*, for roller 151, which is a "dwell" portion (of constant radius), so that during this final 21° of cam rotation, the lever 153 remains stationary and the "hi" valve 27 remains fully open. Thus, in the "ON" or terminal position of the cam 47 (180° from the "OFF" position illustrated in FIG. 13) the " hi" valve 13 is fully open, and the "lo" valve 13** is fully closed.

It has previously been explained, in connection with FIG. 12, how the stepping motor 45 automatically steps in one direction or the other (to rotate the cam 47 in one direction or the other), for automatic control of the valves 13 and 27 during dispensing of a blend. Assume, for purposes of illustration, that a blend is being dispensed; under these conditions, the "lo" roller 152 will be located somewhere in the cam "blend portion" 150d, and the "hi" roller 151 will be located somewhere in the cam "blend portion" 150*e;* this means that the free end of lever 155 will be located somewhere along the arc 161, and the free end of lever 153 will be located somewhere along the arc 160. Both of the valves 13 and 27 will then be partly open (or partly closed). If, now, the logic circuitry of FIG. 12 senses an excess of "hi" gasoline in the blend being dispensed, stepping motor 45 is energized to step the cam 47 in the counterclockwise direction, moving the "lo" valve 13 toward its fully open position (by moving lever 155 upwardly, or clockwise along arc 161) and moving the "hi" valve 27 toward its fully closed position (by moving lever 153 downwardly, or counterclockwise along arc 160). If, on the other hand, the logic circuitry senses a deficiency of "hi" gasoline in the blend, stepping motor 45 is energized to step cam 47 in the clockwise direction, moving the "lo" valve 13 toward its fully closed position (by moving lever 155 downwardly, or counterclockwise along arc 161) and moving the "hi" valve 27 toward its fully open position (by moving lever 153 upwardly, or clockwise along arc 160).

The stepping motor transistors (in 144) for the stepping motor 45 are controlled by a hose switch 191 (later described in more detail), such that when the dispensing nozzle is replaced on its hook (i.e., when the dispensing hose is hung up), power is removed from the motor by transistor operation. When the power is thus removed from motor 45 at the end of a dispensing operation, cam 47 is rotated to the "OFF" position illustrated (wherein valves 13 and 27 are both fully closed) by a spring return means, now to be described.

One end of a flat, spiral "clock" spring 165 (see FIG. 14) is attached to a post 166 secured in the motor support 145, and the other end of this spring is attached to a cylindrical sleeve 167 fastened to the rear face of the cam 47. Spring 165 is so arranged that it is "wound up" (thus creating tension therein) when cam 47 rotates in the "ON" direction 159; when the force (torque of the stepping motor 45) which has so rotated the cam is released (by removal of the power from the stepping motor), the spring 165 "unwinds", rotating the cam 47 back to the "OFF" position of FIG. 13.

Refer now to FIGS. 14 and 15, which illustrate the constructional details of the "lo" valve 13; the "hi" valve 27 is exactly similar, so will not be described in detail. As mentioned previously, one end of a short link 158 is pivotally attached to the free end of lever 155. The other end of link 158 is secured (by means of a threaded coupling 168, which provides for adjustment) to one end of another link 169 the other end of which is pivotally connected to the outer end of a valve actuating arm 170. The inner end of arm 170 is pinned to the outer end of a short valve actuating shaft 171 which is sealed into, and journaled for rotation in, an elbowed valve body 172 which is in turn mounted on and sealed to the outer face of a manifold denoted generally by numeral 173.

The "lo" manifold 173 is mounted on and sealed to the "lo" meter 6. Manifold 173 is separated by a partition 174 into an inlet chamber 175 and an outlet chamber 176. From the inlet chamber 175 (to which the pump 1 of FIG. 1 supplies "lo" gasoline), the "lo" gasoline flows in the direction of arrow 177 through the check valve 12 of more or less conventional construction into and through the meter 6, and thence out of this meter into one end of chamber 176. The valve body 172 is sealed to the "out" end (opposite to meter 6) of chamber 176.

The shaft 171 extends into the interior of body 172, and its inner end passes sealingly through the wall 178 of body 172 which is sealed to the end of chamber 176. The wall 178 has therein four circular ports (holes) 179 which are spaced 90° apart with centers on a base circle having its center on the axis of shaft 171. When these ports are uncovered, the "lo" gasoline can flow in the direction of the arrow 180, through these ports into the hollow interior of the body 172, through this body and then through a tubular coupling member 181 the upper end of which is threaded into the elbow (valve body) 172. The delivery conduit 14 (FIG. 1) is suitably coupled to the lower end of member 181.

For variably covering or uncovering the ports 179, a valve shoe 182, which is arranged to slide (rotate) in intimate contact with the inner face of wall 178, is located in chamber 176 and is fastened to shaft 171 by means of a pin 183 which is secured to the inner end of shaft 171 and which fits in a diametral groove 184 formed in the inner (non-contacting) face of the shoe 182. One end of a coiled compression spring 185 engages the pin 183, and the other end of this spring engages the bottom of a counterbore 186 (in shoe 182) surrounding the inner end of shaft 171. The valve shoe 182 has a cruciform shape (see FIG. 15, wherein the valve 13 is illustrated in fully open position, with the ports 179 not covered by the respective arms of the cruciform shoe, although the actuating mechanism is illustrated in "closed" or "off" position in FIGS. 13 and 14), wherein the four arms of the shoe, as the latter is rotated in one direction or the other over wall 178 by shaft 171, are adapted to variably cover or uncover the ports 179. In the "fully open" position of the valve illustrated in FIG. 15, the ports 179 are located entirely between the cruciform arms of the shoe, and are thus fully uncovered. In the "fully closed" or "off" position of FIGS. 13–14, the shoe 182 would be rotated (by cam 47, acting through mechanism 158, 169, etc. and the shaft 171) to a position wherein the cruciform arms of the shoe fully cover the respective ports 179. The "fully open" position of the "lo" valve 13 would be used for delivery of solely "lo" gasoline, while the "fully closed" position of this valve would be used for delivery of solely "hi" gasoline. In an intermediate position of the valve 13 (roller 152 located in the "blend portion" 150d of cam 47), shoe 182 is rotated by the lever 155 (and the linkage associated therewith, including the shaft 171) to a position such as to partially cover (or partially uncover) the ports 179. Thus, the "lo" blend control valve 13 is operated (in response to the angular position of cam 47) to control the flow of "lo" gasoline from chamber 176 into the coupling member 181 (and hence to the dispensing nozzle).

The "hi" blend control valve 27 is constructed exactly like valve 13, and operates similarly. Valve 27 has at its outlet a tubular coupling member 187 (duplicate of member 181) to the lower end of which the delivery conduit 28 (FIG. 1) is coupled. The "hi" blend control valve 27 is operated (in response to the angular position of cam 47, acting through the linkage 153, 157, etc.) to control the flow of "hi" gasoline from the outlet side of the "hi" meter 20 into the coupling member 187 (and hence to the dispensing nozzle).

It should be apparent that the pipe 11 of FIG. 1 comprises essentially the chamber 176 leading to the valve 13.

For an independent delivery of gasoline (which may or may not be carried on simultaneously with the above-mentioned delivery, using the same pumps 1 and 15, for example), a duplicate cam 47' (see FIG. 13) may be provided, driven by its own, independently-controlled stepping motor. The duplicated items are denoted by the same reference numerals in FIG. 13, but carrying prime designations. The same fixed pivots 154 and 156 may be employed for levers 153' and 155', respectively. The same fixed support 145 may carry the two stepping motors and the two cams 47 and 47' in side-by-side relationship.

The start-up sequence (strobing sequence) of the apparatus of this invention will now be described. Refer to FIGS. 12 and 16. A hose switch 191 (FIG. 2) is associated with the nozzle hook (i.e., the hook on which the dispensing nozzle is hung, or on which it rests, when it is not being used for dispensing purposes) in such a way that it is operated when the nozzle is removed from its hook. When the nozzle is at rest on its hook, there is a low potential (ground) on lead 192 connected to the hose switch, but when the nozzle is off its hook, a relatively high potential is applied to lead 192 (and thus also to one input 193 of the NAND gate 194).

The "high" on lead 192 is applied through inverter 195 to the reset or cllear input R of a flip-flop 196, and through this same inverter, a NOR 197, and another inverter 198 to the reset or clear input R of another flip-flop 199. The two "NOT" outputs of flip-flops 196 and 199 are used as inputs to a NAND 200, and under the conditions stated an enabling voltage for the counter 201 appears at the output 202 of the NAND 200. The counter 201 is a scale-of-eight counter which, when enabled at its "clock enable" terminals, produces, in response to clock pulses supplied thereto at its CL terminal, pulses at its several output terminals in a regular succession or order, from "zero" through "seven". Clock pulses of 1000 Hz are supplied to the CL terminal of counter 201 from the output of the divider unit 55 (FIG. 2) by way of a lead 203. As previously stated, divider unit 55 is operative continuously, regardless of whether or not dispensing is taking place.

Thus, when the dispensing nozzle is removed from its support (hook), counter 201 is enabled and begins to produce pulses at its output terminals. This starts the strobing sequence, a "strobe" comprising a single pulse, analogous to a test pulse. Upon the enabling of counter 201 as aforesaid, pulses are produced at the counter output terminals, beginning at the "zero" output terminal. The first pulse appearing at the "one" output terminal of counter 201 may be termed "strobe 1", abbreviated as "STB 1" in the drawings.

Strobe 1 is fed by way of a lead 204 (FIG. 7) to the reset terminals (R) of all of the blend select flip-flops $85_1$– $85_5$, thereby arrangement. reset all of these flip-flops.

Strobe 1 is also fed by way of a lead 205 (FIG. 17) to the reset terminal (RST) of the paired position detector counter arrangement 206, 207, thereby to reset this counter arrangement.

Strobe 1 is also fed by way of a lead 208 (FIG. 12) to the reset terminals (R) of various flip-flops 209,210,211 and 212 (to be later referred to in more detail) in the valve prepositioning circuit, thereby to reset these flip-flops and thus enable the pre-positioning circuit.

As the counting continues in counter 201, a short time later (in the regular order of succession) a pulse will appear at the "three" output terminal of this counter. This last-mentioned pulse may be termed "strobe 2", abbreviated as "STB2" in the drawings. Strobe 2 is fed through an inverter 213 to a lead 214 (FIG. 7) which is connected to one terminal of each of the blend select switches (pushbuttons) $29_1$–$29_5$, thereby to enable these switches for the selection of a product to be dispensed. Strobe 2 is also fed by way of a lead 215 to the toggle T of flip-flop 199, reversing the state of the latter, which reverses the voltage appearing at output 202, disabling the counter 201 and stopping the count. So, strobe 2 is not completed as a pulse at this time, maintaining an enabling voltage on lead 214 until a selection is made by manual operation of one of the switches $29_1$–$29_5$; thus, strobe 2 provides a "wait" for a blend selection to be made.

Strobe 2 is also fed as a "high" to a second input 216 of the NAND gate 194.

Refer again to FIG. 7. The "Q" output terminals of the five blend select flip-flops $85_1$–$85_5$ are coupled through a pair of coordinated NOR gates 217 and 218 to an NAND gate 219 which can provide at its output 220 a "blend selected" signal. When one of the pushbuttons $29_1$–$29_5$ is manually operated, the state of the corresponding one of the blend select flip-flops $85_1$–$85_5$ is reversed (as previously described). This reverses one or the other of the NOR gates 217 or 218 as compared to its rest or quiescent state, providing at 220 a "high" signal (for "blend selected") which is fed to the third input 221 of the NAND gate 194 (FIG. 16).

In FIG. 7, it may be seen that the "Q-NOT" output terminals of the five blend select flip-flops $85_1$–$85_5$ are connected to selection indicator circuits (not shown) which function to provide an indication of the particular blend selection that has been made.

When the blend selection has been made as above, all three of the inputs to the NAND 194 are "high", as previously explained. When this occurs, a "high" is produced at the reset R of flip-flop 199, reversing the state of this flip-flop and thus re-enabling the counter 201 by way of output 202 and the counter "clock enable" terminal. Counting is then resumed in counter 201, terminating strobe 2 (at the "three" output terminal); a short time later (in the regular order of succession) a pulse will appear at the "five" output terminal of this counter. This last-mentioned pulse may be termed "strobe 3", abbreviated as "STB 3" in the drawings.

Strobe 3 is fed to a pump starter (pump start circuit) schematically represented at 222 (FIG. 2); this pump starter circuit may include a flip-flop (not shown) to the "set" input of which strobe 3 is fed. Strobe 3 reverses the state of this flip-flop, so that pumps 1 and 15 (FIG. 1) are started upon the appearance of the strobe 3 pulse. It may be stated here that if remote pumps (supplying more than one dispenser) are being used, they may already be on, before the appearance of the strobe 3 pulse.

Strobe 3 is also fed by way of a lead 223 (FIG. 4) to the reset terminals (RST) of the counters 31, $32_1$, $32_2$, $32_3$, and $32_4$, thereby to reset all of these (gallons) counters. Strobe 3 is fed by way of a lead 224 (FIG. 10) to the reset terminals (RST) of the counters $37_1$–$37_4$, thereby to reset all of these (dollars) counters.

Strobe 3 may also be used to trigger a "lamp test" circuit (not illustrated) utilizing, for example, a one-shot having an on time of two seconds, for example; this "lamp test" circuit operates to cause all of the liquid crystal digits $39_1$ –$39_4$ and $38_1$–$38_4$ to display "eights" for two seconds, thus establishing that all of the circuitry for energizing these displays is operating properly.

Strobe 3 is also used in the valve pre-positioning circuitry, as will be described hereinafter; however, before describing such circuitry, the description of the strobe generator of FIG. 16 will be completed. As previously mentioned, counting is resumed in counter 201 when the blend selection has been made, producing strobe 3 at the "five" output terminal of this counter. As the count continues in 201, in the regular order of succession a pulse will appear at the "seven" output terminal of this counter. This latter pulse is fed by way of a lead 272 to the toggle T of flip-flop 196, reversing the state of the latter, which reverses the voltage appearing at output 202, disabling the counter 201 and stopping the count. Counter 201 is reset along with flip-flops 199 and 196, when the dispensing nozzle is again removed from its hook, for a subsequent dispensing operation.

Pulses at a 250 Hz repetition rate, phase 1, are taken from the output of the generator 57 (FIG. 2) and fed by way of a lead 225 to the toggle input T of a flip-flop complementary 226, which operates as a frequency divider with a division factor of two. It will be recalled, from the previous description, that the oscillator-divider combination 53-55-57 operates continuously, regardless of whether or not dispensing is taking place; thus, pulses at a rate of 125 Hz appear on the flip-flop output connection 227 and are fed as one input to each of the NAND gates 228, 229, and 230. The outputs of the three gates 228–230 are used respectively as the three inputs to a NOR 231, and the output of the latter is used as one of the inputs to a NOR 135 the output of which supplies the "clockwise" or "ON" single shot 136 previously referred to.

The "Q-NOT" output of the "lo" blend select flip-flop $85_5$ (FIG. 7) is fed by means of a lead 232 to one input of the NOR gate 233, to feed an "economy regular" signal ("low" when this grade is selected by actuation of the blend select switch $29_5$, FIG. 7) to this latter gate. The output of gate 233 is applied to the set input S of the flip-flop 212. The Q output 236 of the flip-flop 212 is utilized as the second input of NAND 228 (the other input of the latter, as stated previously, being the 125 Hz pulses from the divider flip-flop 226).

The "Q-NOT" output of the flip-flop 209 is applied to the inputs of the three NOR gates 233, 234, and 235, and this flip-flop output is such as to normally (i.e., when dispensing is not taking place) block all three of these gates. However, the strobe 3 pulse, fed to the set input S of flip-flop 209, reverses the state of this flip-flop and thus removes the blocking potential from these gates 233–235.

First assume, for purposes of illustration, that the "economy regular" grade (that is, solely "lo" gasoline) has been selected for dispensing, by actuation of the pushbutton switch $29_5$ (FIG. 7).

Since the strobe 3 pulse has at this time caused the unblocking of gates 233-235, the "economy regular" signal appearing on lead 232 acts through flip-flop 212 to cause a "high" on lead 236 which "opens" the NAND 228, resulting in the 125 Hz rate pulses from divider 226 being applied to one input 237 of the NOR 231. Since the other two inputs to the latter are "high" at this time, the 125 Hz pulses appear at the output 238 of NOR 231, and pass through the NOR 135 to the toggle input T of the "ON" or "clockwise" single shot 136. The resulting pulses in the output of the one shot 136 cause (in the same manner as described above, in connection with the automatic blend control action) energization of the stepping motor 45 in the "ON" direction (i.e., such that the motor steps the cam 47 in the clockwise direction in FIG. 13). When the first 125 Hz pulse is applied to the input T of single shot 136, a signal of appropriate polarity is fed by lead 239 back to the toggle input T of flip-flop 209, reversing this flip-flop back to its "normal" state and re-blocking all of the gates 233–235. This prevents any subsequent changes of state in the flip-flops 210-212, and thus any improper operation of the valve pre-positioning circuitry. Thus, once a given pushbutton has been depressed, no other pushbutton, although depressed, has any effect on the operation of the system until the system has been reset.

Refer now to FIGS. 13, 14, and 14a. The slotted disc 148 is fastened to the same shaft 147 (driven by stepping motor 45) which carries the cam 47, and this disc has therein five slots, one for each of the five grades of motor fuel which may be selected for dispensing. Cooperating with this disc is a fixed light-emitting-diode-phototransistor pickup combination (illustrated at 103) which produces an electrical pulse each time one of the five slots passes by the pickup. The first 105 of these five slots in disc 148 is correlated with the position of the control valves for dispensing solely "lo" gasoline (valve 13 fully open and valve 27 fully closed), and is spaced approximately 80° from the pickup position, so that this slot 105 will be aligned with the pickup 103 when the cam 47 and the disc 148 have rotated 80° from the "OFF" position illustrated in FIG. 13. Thus, the first pulse will be produced by the pickup when the cam and the slotted disc 148 have rotated 80° from "OFF", in the clockwise or "ON" direction of the cam (which direction is counterclockwise in FIG. 14*a*).

The fifth 107 of the five slots in disc 148 is correlated with the position of the control valves for dispensing solely "hi" gasoline (valve 27 fully open and valve 13 fully closed), and is spaced 180° from the pickup position, so that this slot will be aligned with the pickup when the cam 47 and the disc 148 have rotated 180°from the "OFF" position. Thus, a total of five pulses will have been produced by the pickup when the cam and the slotted disc 148 have rotated 180°from "OFF", in the "ON" direction of the cam.

The remaining three slots 109, 126, and 127 in disc 148 are correlated respectively with the three blends A, B, and C, and are distributed around the disc in the space between the first and fifth slots, at locations appropriate to the individual blends (utilizing the "blend portions" 150*d* and 150*e* of the cam 47, in which both of the valves 13 and 27 are partially open). Therefore, and by way of recapitulation, as the disc 148 rotates in the "ON" direction, and starting from the "OFF" position of the valves, the first pulse from the pickup on the disc (at slot 105) corresponds to the pre-established valve position for dispensing "economy regular" or "lo" gasoline; the second pulse (at slot 127) corresponds to the pre-established valve position for dispensing "regular" or Blend C; the third pulse (at slot 126) corresponds to the pre-established valve position for dispensing "super regular" or Blend B; the fourth pulse (at slot 109) corresponds to the pre-established valve position for dispensing "permium" or Blend A; the fifth pulse (at slot 107) corresponds to the pre-established valve position for dispensing "super premium" or "hi" gasoline.

It has been explained previously how, once the blend selector switch $29_5$ (FIG. 7) has been actuated for selection of "economy regular", energization pulses are supplied to stepping motor 45 to cause the same to drive cam 47 in the "ON" direction. Pulses from the pickup on the slotted disc 148 of FIG. 14 (which disc is driven by stepping motor 45, along with cam 47) are applied through an inverter 240 (FIG. 17) to the "CL" input of the up/down counter 206, the binary coded output of which is connected to the input of a decimal counter 207 which has output terminals labeled "zero" through "nine". The sequential pulses from the disc pickup result in the production of signals at the output terminals of counter 207, in regular succession.

The pulses from the disc pickup 148 are also applied to the inputs of the respective NAND gates 241, 242, and 243, by means of a connection 244. As the slotted disc rotates in the 37 ON" direction, the first pulse produced by its pickup appears at the "one" output terminal of counter 207 and is applied to the input of NAND 241, causing an "economy regular detected" signal to appear at its output 245; this latter signal is fed through an inverter 246 (FIG. 12) to the toggle input T of flip-flop 212, reversing the state thereof, producing a "low" at 236 which "closes" the gate 228. "Closing" of gate 228 cuts off the supply of 125 Hz pulses from the motor drive circuit, so the stepping motor 45 stops; as a result, the blend control valves are then pre-positioned for the dispensing of "economy regular" or "lo" gasoline (i.e., "lo" valve 13 fully open and "hi" valve 27 fully closed. Dispensing of "lo" gasoline can then begin, and can proceed in the manner described hereinabove (that is, with quantity and cost displays, etc.).

Since no automatic control of the blend is needed for the dispensing of solely "lo" gasoline, the automatic blend control circuitry previously described must be disabled under this dispensing condition. When "economy regular" is selected for dispensing, the "low" on lead 232 (from the "blend select" flip-flop $85_5$, FIG. 7) is effective on one inut of the NAND 247, resulting in a "high" at the output 248 of the latter, which is applied to one input of the NOR 134 to cause this gate to be "blocked". As a result, no % "hi" pulses from the % switches 40 can reach the "ON" or "clockwise" one-shot 136. Similarly, the "high" at 248 is applied to one input of the NOR 139 to cause this gate to be "blocked"; as a result, no "hi" pulses from the generator 22 can reach the "OFF" or "counterclockwise" one-shot 140.

Now, assume that the "super premium" grade (that is, solely "hi" gasoline) has been selected for dispensing, by actuation of the pushbutton switch $29_1$ (FIG. 7). The "Q-NOT" output of the "hi" blend select flip-flop $85_1$ is fed by means of a lead 249 to one input of the NOr gate 235, to feed a "super premium" signal ("low" when this grade is selected by actuation of the blend select switch $29_1$) to this latter gate. The output of gate 235 is applied to the set input S of the flip-flop 210. The Q output 250 of the flip-flop 210 is utilized as the second input of NAND 230 (the other input of the latter being the 125 Hz pulses from the divider flip-flop 226).

As before, the strobe 3 pulse has at the time under consideration (i.e., at the time of grade selection) caused the unblocking of gates 233–235 (by the action of flip-flop 209). Hence, the "super premium" signal appearing on lead 249 acts through flip-flop 210 to cause a "high" on lead 250 which "opens" the NAND 230, resulting in the 125 Hz pulses from divider 226 being applied to one input 251 of the NOR 231. Since the other two inputs to the latter are "high" at this time, the 125 Hz pulses appear at the output 238 of NOR 231, and pass through the NOR 135 to the toggle input T of the "ON" or "clockwise" single shot 136. The resulting pulses in the output of the one shot 136 cause energization of the stepping motor 45 in the "ON" direction.

As the slotted disc 148 (which is driven by stepping motor 45) rotates in the "ON" direction, pulses are again produced in sequence by the pickup associated with this disc. The fifth pulse from the pickup appears at the "five" output terminal of counter 207 and is applied to the input of NAND 243, causing a "super premium detected" signal to appear at its output 252; this latter signal is fed through an inverter 253 to the toggle input T of flip-flop 210, reversing the state thereof, producing a "low" at 250 which "closes" the gate 230. "Closing" of gate 230 cuts off the supply of 125 Hz pulses from the motor drive circuit, so the stepping motor 45 stops; as a result, the blend control valves are then pre-positioned for the dispensing of "super premium" or "hi" gasoline (i.e., "hi" valve 27 fully open and "lo" valve 13 fully closed). Dispensing of "hi" gasoline can then begin, and can proceed in the manner described previously (that is, with quantity and cost displays, etc.).

As set forth hereinabove, the starting up of the pumps 1 and 15 may be initiated (if they are not already on) upon the appearance of the strobe 3 pulse, and the pre-positioning of the blend control valves 13 and 27 is initiated upon the operation of one of the blend select buttons 29; the strobe 3 pulse appears substantially simultaneously with the blend select button operation. However, there can be no dispensing of a liquid fuel having a composition other than that called for (which is to say that the valve pre-positioning will ordinarily be completed before the pumps are started up), and this even though the hose nozzle is manually held open while the blend select button is operated. As described, 125 Hz pulses (that is, pulses occurring at a rate of 125 per second) are used for the stepping motor 45 when pre-positioning the valves; thus, even for the "worst" pre-positioning condition (the maximum rotation of 180° of cam 47, from the "OFF" position), a time of only a little over one second will be required to complete the valve pre-positioning;

whereas, due to mechanical inertia, etc. the pumps will ordinarily not start up in a time interval as short as this.

When using remote or submerged pumps, they may be on when the blend select button is operated; if the hose nozzle is held open when this button is operated, and if a high octane product is being asked for, some lower octane product will be dispensed as the valves 13 and 27 are being brought to the higher-octane position. However, the actual amount of such lower octane product will be inconsequential.

Again, since no automatic control of the blend is needed for the dispensing of solely "hi" gasoline, the automatic blend control circuitry is disabled when "super premium" is selected for dispensing. When "super premium" is selected, the "low" on lead 249 (from the blend select flip-flop $85_1$) is effective on one input of NAND 247, resulting in a "high" at the output 248 of the latter, which again "blocks" the NOR gate 134. Also, the "high" at 248 causes the NOR gate 139 to be "blocked".

For pre-positioning the blend control valves when one of the blends A, B, and C has been selected for dispensing, transfer gates (solid-state switches) 188, 189, and 190 (one for each of the three blends, each quite similar to items 86–93, previously referred to) are utilized. Gate or switch 188 is controlled from the "premium" or Blend A flip-flop $85_2$ (FIG. 7), as are gates 87 and 88; when this blend is selected for dispensing by operation of button $29_2$, switch 188 "closes" to connect the "four" output terminal of counter 207 to a common output lead 254 which extends to the input of NAND 242. Gate or switch 189 is controlled from the "super regular" or Blend B flip-flop $85_3$, as are gates 89 and 90; when this blend is selected for dispensing by operation of button $29_3$, switch 189 "closes" to connect the "three" output terminal of counter 207 to common lead 254. Gate or switch 190 is controlled from the "regular" or Blend C flip-flop $85_4$, as are gates 91 and 92; when this blend is selected for dispensing by operation of button $29_4$, switch 190 "closes" to connect the "two" output terminal of counter 207 to common lead 254.

The valve pre-positioning operation occurring when one particular blend is selected for dispensing will now be specifically set forth; the operation for the other two blends is quite similar and can be readily understood after studying what now follows.

Assume that the "premium" grade or Blend A has been selected for dispensing, by actuation of the push-button switch $29_2$ (FIG. 7). This results in the "closing" of switch 188 (FIG. 17). If a "blend selection" is made that is not "economy regular" or "super premium", both inputs to NAND 247 (FIG. 12) remain "high", giving a "low" at the output 248. The strobe 3 pulse having at this time caused the unblocking of gates 233–235, the signal appearing on 248 acts through the NOR 234 to change the state of flip-flop 211, giving a "high" on its output lead 273 which "opens" the NAND 229, resulting in the 125 Hz pulses from divider 226 being applied to one input 255 of the NOr 231. Since the other two inputs to the latter are "high" at this time, the 125 Hz pulses appear at the output 238 of NOR 231, and pass through the NOR 135 to the toggle input T of the "ON" or "clockwise" single shot 136. The resulting pulses in the output of the one shot 136 cause energization of the stepping motor 45 in the "ON" direction.

As the slotted disc 148 driven by this motor rotates in the "ON" direction, pulses are produced in sequence by the disc pickup. The fourth pulse from the pickup appears at the "four" output terminal of counter 207 and passes through the "closed" switch 188 to lead 254 (input of NAND 242), causing a "mid-point detected" signal to appear at its output 256; this latter signal is fed through an inverter 257 to the toggle input T of flip-flop 211, reversing the state thereof, producing a "low" at 273 which "closes" the gate 229. "Closing" of gate 229 cuts off the supply 125 Hz pulses from the motor drive circuit, so the stepping motor 45 stops; as a result, the blend control valves are then pre-positioned for the dispensing of "premium" or Blend A gasoline (i.e., valves 13 and 27 both partially open). Dispensing of "premium" gasoline can then begin, and can proceed in the manner described previously (that is, with quantity and cost displays, etc.).

Under conditions of dispensing any one of the three blends (A, B, or C), there is a "low" at the output 248 of the NAND 247, so the NOR gates 134 and 139 are not "blocked". Therefore, the automatic blend control circuitry previously described is enabled under these conditions, and can operate (during dispensing of a blend) in the manner set forth hereinabove. More particularly, % "hi" pulses from the % switches 40 are fed through gate 134 to the "ON" or "clockwise" one-shot 136, and "hi" pulses from the generator 22 are fed through gate 139 to the "OFF" or "counterclockwise" one-shot 140.

When a dispensing operation is complete, the dispensing nozzle is replaced on its supporting hook (and in its boot) on the dispenser housing. The weight of the nozzle, effective on its hook, causes the hose switch 191 to be operated in reverse fashion (as compared to the operation thereof when the switch is removed from its hook, at the start of the dispensing operation). This reverse operation of the hose switch in effect removes power (by transistor control) from the stepping motor 45, which causes cam 47 to be rotated to its "OFF" position (wherein valves 13 and 27 are both fully closed) by the spring return means 165 previously described.

This reverse operation of the hose switch also resets the "pump starter" flip-flop previously referred to (i.e., the flip-flop in the pump starter circuit 222, to the "set" input of which strobe 3 is fed), thus turning off the pumps 1 and 15.

Refer now to FIG. 18, which is a diagrammatic view of one typical physical layout utilizing the apparatus of the invention. Illustrated is a two-outlet arrangement (duo-blender) utilizing a pedestal mounting. On an "island" 258 of usual configuration there is mounted a vertically-extending hollow column (pedestal) 259 fastened to the top of which is a rigid horizontal hollow boom 260. A "meter unit" 261, containing most of the mechanical components of the apparatus, is mounted at one end of the island 258. To the unit 261 there are supplied the "lo" and "hi" gasolines or blending components by means of two lines 262, from submersible pumps located in respective subterranean storage tanks (not shown).

Included in the meter unit 261 are four meters (one "lo" meter and one "hi" meter for each of the two dispensing outlets), two filters (one for the combined or manifolded "lo" gasoline flow of both outlets and one for the combined or manifolded "hi" gasoline flow of both outlets), four blend control valves (one "lo"

valve and one "hi" valve for each of the two outlets), two valve operators (in a dual arrangement such as illustrated in FIG. 13), and four meter pulsers (one for each of the four meters).

Mounted on the column (pedestal) 259, at a convenient height for manual operation, are two completely independent and duplicate blend control boxes (computers), mounted back-to-back in a single cabinet 263. Each of the two blend control boxes includes a set of blend select pushbuttons, a gallons display, a price display, plus all the digital logic circuitry which has been described, including the price selector switches, the % "hi" selector switches, the blend controlling circuitry, the start-up strobing circuitry, the pulse summing circuitry, etc. One electrical conduit 264 carries all the electrical wires necessary between the control unit 263 and the meter unit 261, including the wires for the stepping motors in the meter unit, the wires leading from the meter pulsers in the meter unit, etc.

Also, there are four liquid-carrying pipes 265 (one "hi" pipe and one "lo" pipe for each of the two outlets), one connected to the outlet side of each of the four valves in unit 261; these four pipes extend from the unit 261 up the hollow interior of the column 259 and out the boom 260, the paired pipes for one outlet extending out along the boom from the column in one direction, and the paired pipes for the other outlet extending out along the boom from the column in the opposite direction.

Connected to the outer ends of the pipes, at one end of the boom 260, is a dual hose 266 supplying a dispensing nozzle (for one outlet); connected to the pipes at the opposite end of the boom is a dual hose 267 supplying a dispensing nozzle (for the other outlet).

From the control unit 263, two wire-carrying conduits 268 extend to a building 269, in which may be located the power supply for all of the electrical equipment, and totalizers (the power supply plus totalizers being represented by a single box 270), and also a remote self-service console 271 including gallons and price indicators.

The invention claimed is:

1. A system for proportioning a pair of liquids and comprising:

a. a pair of flow conduits, one for each liquid;

b. means in each conduit for sensing the flow of liquid therethrough and for providing a train of individual pulses the number of which is proportional to the integrated liquid flow rate through the conduit;

c. means for summing the two pulse trains to produce a series of pulses the total number of which is representative of the combined volumetric liquid flow through both of said conduits;

d. gating means receptive of said series of pulses for passing therethrough only a selected percentage of said such pulses;

e. valve means in each conduit for adjusting the flow of liquid therethrough; and f. means for controlling both of said valve means and including means for differentially comparing the pulse outputs of said gating means and of said sensing means in one conduit, to produce an output pulse control signal representative of differences between the compared pulses, and a bidirectional rotary stepping motor means, responsive to said output pulse control signal, for stepping in a number of discrete steps in one rotary direction or the other to control both of said valve means to achieve a selected proportioning of the pair of liquids, and a dual control cam means mechanically coupled for rotation with said stepping motor means and having a first portion of its cammed surface controlling one of said valve means and a second portion of its cammed surface controlling the other of said valve means.

2. A system as set forth in claim 1 wherein said dual control cam means includes means defining a closed position in which both of said valve means are fully closed, and means for biasing said dual control cam means towards said closed position when the system is not being utilized.

3. A system as set forth in claim 2 wherein the liquids are motor fuels or different octane rating which are proportioned and then blended to constitute a fuel product.

4. A system as set forth in claim 3 and including means for selectively setting the percentage of pulses passed by said gating means.

5. A system as set forth in claim 4 wherein said means for selectively setting includes manually-operable means for selecting for blending any one of a plurality of discrete pre-set ratios of the motor fuels of different octane ratings.

6. A system as set forth in claim 5 and including means for prepositioning said dual control cam means when the system is first started up such that the initial proportioning of the pair of liquids is substantially correct.

7. A system as set forth in claim 6 wherein said means for prepositioning includes means, mechanically coupled to said stepping motor, for generating prepositioning pulses as the stepping motor continues to step said dual control cam means away from said fully closed position, and means responsive to said prepositioning pulses for stopping said stepping motor when a selected number of prepositioning pulses has been received.

8. A system as set forth in claim 7 wherein the system includes means for generating two out of phase electrical signals, said summing means includes means for utilizing said two out of phase electrical signals for capturing coincident pulses from each of said sensing means, and said bidirectional rotary stepping motor means utilizes one of said two out of phase signals in its stepping operation.

9. A system as set forth in claim 1 and including means for prepositioning said dual control cam means when the system is first started up such that the initial proportioning of the pair of liquids is substantially correct.

10. A system as set forth in claim 9 wherein said means for prepositioning includes means, mechanically coupled to said stepping motor, for generating prepositioning pulses as the stepping motor continues to step said dual control cam means away from said fully closed position, and means responsive to said prepositioning pulses for stopping said stepping motor when a selected number of prepositioning pulses has been received.

11. A system as set forth in claim 10 wherein the system includes means for generating two out of phase electrical signals, said summing means includes means for utilizing said two out of phase electrical signals for capturing coincident pulses from each of said sensing means, and said bidirectional rotary stepping motor means utilizes one of said two out of phase signals in its stepping operation.

* * * * *